US011873816B2

(12) United States Patent
Porter

(10) Patent No.: US 11,873,816 B2
(45) Date of Patent: Jan. 16, 2024

(54) ROTARY VANE DEVICE WITH LONGITUDINALLY EXTENDING SEALS

(71) Applicant: Regi U.S., Inc., Spokane, WA (US)

(72) Inventor: Paul Porter, Colbert, WA (US)

(73) Assignee: Regi U.S., Inc., Spokane, WA (US)

( * ) Notice: Subject to any disclaimer, the term of this patent is extended or adjusted under 35 U.S.C. 154(b) by 37 days.

(21) Appl. No.: 17/550,722

(22) Filed: Dec. 14, 2021

(65) Prior Publication Data

US 2023/0184127 A1 Jun. 15, 2023

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/348*** | (2006.01) |

(Continued)

(52) U.S. Cl.

CPC ..... *F04C 2/348* (2013.01); *F01C 19/02* (2013.01); *F01C 21/0836* (2013.01); *F01C 21/0845* (2013.01)

(58) Field of Classification Search

CPC ..... F04C 2/3448; F04C 2/348; F04C 2/3568; F04C 18/3448; F04C 18/3568; F01C 1/3448; F01C 19/02; F01C 21/0818; F01C 21/0836; F01C 21/0845; F16J 15/447; F16J 15/4472; F16J 15/4474; F16J 15/4476; F16J 15/4478

See application file for complete search history.

(56) References Cited

U.S. PATENT DOCUMENTS 4,917,584 A * 4/1990 Sakamaki ..... F01C 21/0836 418/256
5,509,793 A * 4/1996 Cherry ..... F01C 1/3448 418/230

(Continued)

FOREIGN PATENT DOCUMENTS

CN 108361384 A * 8/2018 ..... F16J 15/447
WO WO-2016059866 A1 * 4/2016 ..... F16J 15/447
WO WO-2020045062 A1 * 3/2020 ..... F16J 15/447

OTHER PUBLICATIONS

CN-108361384-A—Chen Y—A Labyrinth Sealing Structure With Inner Sealing Tooth—Aug. 3, 2018—the English Machine Translation. (Year: 2018).*

(Continued)

*Primary Examiner* — Theresa Trieu
(74) *Attorney, Agent, or Firm* — Lee & Hayes, P.C.

(57) ABSTRACT

A rotary device includes a shaft, a rotor coupled to the shaft, and a stator having a cam surface. Vanes reside within slots of the rotary device and engage with the cam surface. A first seal couples to the rotor and includes first grooves that extend in a direction substantially parallel to a rotational axis of the shaft. A second seal couples to the stator and includes second grooves extending in the direction substantially parallel to the rotational axis. A third seal couples to the rotor and includes third grooves extending in the direction substantially parallel to the rotational axis. A fourth seal couples to the stator and includes fourth grooves extending in the direction substantially parallel to the rotational axis. The first grooves and the second grooves, as well as the third grooves and the fourth grooves, from labyrinth seals for the chambers of the rotary device.

20 Claims, 19 Drawing Sheets

(51) Int. Cl.
*F01C 19/02* (2006.01)
*F01C 21/08* (2006.01)

(56) References Cited

U.S. PATENT DOCUMENTS 6,682,077 B1 * 1/2004 Letourneau ..... F16J 15/4476
277/412
2008/0136113 A1 * 6/2008 Grisar ..... F01C 1/3448
418/261

OTHER PUBLICATIONS

WO-2016059866-A1—Hirano—Labyrinth Seal, centrifugal Compressor and Supercharger—Apr. 21, 2016—the English Machine Translation. (Year: 2016).*
WO-2020045062-A1—Hamamoto K—Sealing Structure for a Resin Cover—Mar. 5, 2020—the English Machine Translation. (Year: 2020).*

* cited by examiner

ROTARY VANE DEVICE WITH LONGITUDINALLY EXTENDING SEALS

BACKGROUND

Rotary vane devices, such as compressors, engines, expanders, or pumps, include chambers that receive a working fluid. During operation, vanes of the rotary device engage with a rotor and a stator to seal the chambers. For example, the vanes may translate into and out of the rotor to engage with a surface of the stator. This translation of the vanes creates chambers that change in volume to expand, compress, or pump the working fluid. In conventional rotary vane devices, however, working fluid is lost at an interface between the rotor and the stator. In some instances, bushings or other gaskets may be used to seal the interface. Nevertheless, these designs suffer from high friction loads and wear, which may ultimately lead to failure and poor efficiencies.

BRIEF DESCRIPTION OF THE FIGURES

The detailed description is described with reference to the accompanying figures. In the figures, the left-most digit(s) of a reference number identifies the figure in which the reference number first appears. The use of the same reference numbers in different figures indicates similar or identical components or features. The devices depicted in the accompanying figures are not to scale and components within the figures may be depicted not to scale with each other.

DETAILED DESCRIPTION

Figure 1:
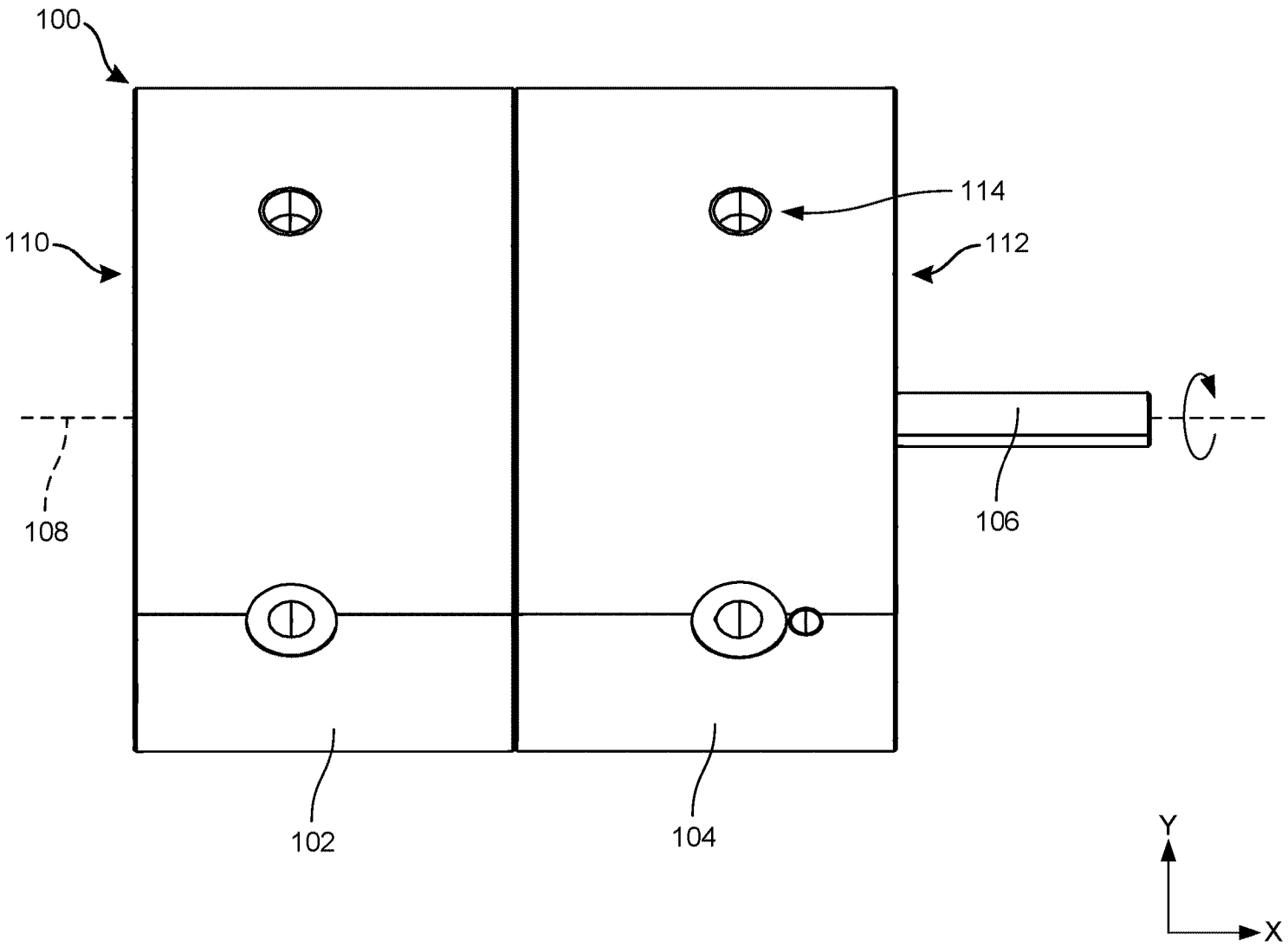
FIG. 1 illustrates a perspective view of an example rotary device, accordance to an example of the present disclosure.

This disclosure is directed, at least in part, to sealing a rotary device using labyrinth seals and pressure-assist. In some instances, the rotary device includes a rotor having slots that receive vanes. The vanes axially translate within the slots, and an end of the vanes external to the slots undulates along a cam surface of a stator as the rotor rotates. The translation of the vanes, as well as the traversing of the vanes along the cam surface, adjusts a volume of a working fluid within chambers formed at least in part by the rotor, the vanes, and the stator. Seals, such as labyrinth seals, are located at an interface between the rotor and the stator. In some instances, the labyrinth seals are oriented in a direction substantially parallel to a rotational axis of the rotor. In effect, the labyrinth seals provide a tortuous path to prevent leakage of the working fluid from the chambers. Additionally, the slots are sized such that the working fluid forces the vanes into contact with sidewalls of the slot, as well as against the cam surface. In doing so, an amount of force that seals the vanes against the sidewalls of the slot and the cam surface varies based on an amount of pressure within the chambers. As such, the seals of the rotary device limit working fluid leaking from the chambers, reduce friction experienced by the vanes and the cam surface, and reduce wear on the vanes and cam surface.

In some instances, the rotor represents a rotating portion of the rotary device while the stator represent a stationary portion of the rotary device. During operation, the rotor rotates about an axis while the stator remains stationary. For example, the rotor may couple to a shaft and rotate about an axis extending through the shaft. The rotor includes a body that defines slots configured to receive the vanes. As the rotor rotates, the vanes axially translate at least partially into and at least partially out of the slots so as to engage the cam surface. Biasing members, for example, springs, bias the vanes in a direction towards the cam surface. This biasing members assist in maintaining contact between the vanes and the cam surface, thereby sealing the chambers. For example, as the rotor rotates, the vanes undulate along the cam surface and the biasing members force the vanes into contact with the cam surface. The cam surface, for example, may represent a sinusoidal surface. In alternative embodiments, the rotor may be stationary and the stator may rotate. In such instances, the vanes axially translate within the rotor, but may not rotate during rotation of the stator.

The rotor, stator, the vanes, and seals define chambers of the rotary device. Within the chambers, the volume of the working fluid changes. For example, given the undulating cam surface of the stator, the volume within the chambers changes during movement of the vanes along the cam surface. This change in volume provides expansion, compression, or pumping actions. For example, the chambers may facilitate a conversion of a working fluid to mechanical energy that drives the rotor in relation to the stator. Here, the working fluid may be received as an energy source and converted to mechanical energy, for example, during combustion, or expansion. As another example, the working fluid may be received and compressed. Another example, working fluid may be transported as in a pump.

In some instances, a first end of the chamber may be defined by the rotor and a second, opposite end, may be defined by the cam surface of the stator. The vanes, such as adjacent vanes disposed within the rotor, may define a first lateral side and a second lateral side of the chamber. Additionally, a first seal coupled to the rotor and a second seal coupled to the stator may define a third lateral side of the chamber, while a third seal coupled to the rotor and a fourth seal coupled to the stator define a fourth lateral side of the chamber. In some instances, the first seal and the second seal may represent a first labyrinth seal of the rotary device, while the third seal and the fourth seal may represent a second labyrinth seal of the rotary device. However, in some instances, the rotary device may include one of the first labyrinth seal or the second labyrinth seal, or may include a greater number of labyrinth seals.

In some instances, the labyrinth seals include interlocking or complimentary shapes (e.g., grooves, corrugations, tabs, channels, etc.). Generally, a labyrinth seal is composed by two mating shapes that collectively form a tortuous path. This tortuous path assists in maintaining a pressure with the rotary device and prevents leakage of the working fluid from within the chambers. The first labyrinth seal and the second labyrinth seal may prevent the working fluid leaking between chambers, as well as the working fluid leaking in to an environment of the rotary device. In some instances, the first seal, the second seal, the third seal, and/or the fourth seal may include an number of interlocking features that provide the labyrinth seals. In some instances, the interlocking features of the labyrinth seals extend in a direction that is substantially parallel to the rotational axis of the rotary device.

In some instances, the shape of the labyrinth seals may have different contours or features depending on the working fluid, speeds of the rotary device, and/or pressures of the working fluid within the chambers. Additionally, the number of interlocking features may be dependent upon the working fluid, speeds of the rotary device, and/or pressures of the working fluid within the chambers. However, although the first labyrinth seal or the second labyrinth seal are described as having complimentary features that interlock, in some instances, the seals may be formed by features that create an "aerodynamic dam" or "hydrodynamic dam" that prevent the working fluid escaping the chamber.

The first seal and the third seal may be press-fit or otherwise coupled to the rotor, while the second seal and the fourth seal may be press-fit or otherwise coupled to the stator. In some instances, the first seal and the third seal may represent a ring, disc, or the like that couples to the rotor. The third seal may annularly extend around the first seal, such that the first seal resides within a perimeter of the third seal. Additionally, or alternatively, the fourth seal may annularly extend around the second seal, such that the second seal resides within a perimeter of the fourth seal. The second seal and the third seal may represent a ring, disc, or the like that couples to the stator. As such, the first seal and the third seal are configured to rotate with the rotor, while the second seal and the fourth seal are configured to remain stationary with the stator. However, the first seal and the third seal, as well as the second seal and the fourth seal, are designed to have a close rotating fit such that there is minimal or no contact, and therefore, minimal friction or wear imparted to the rotor and/or the stator (or the seals). Additionally, the pressure drop across an interface between the first seal and the second seal, as well the third seal and the fourth seal, may be greater than a pressure within the chambers. This pressure drop provides a sealing effect to prevent escape of the working fluid from the chambers.

The rotor and the vanes are also shaped and sized such that the pressures within the chambers seals the vanes against the sidewalls of the slots and against the cam surface. For example, the slots in which the vanes are received are sized larger than the vanes themselves to allow for the working fluid to apply both a lateral force against to the vane onto the sidewall of the slot, and a longitudinal force against the vane and the cam surface. That is, the lateral force may press the vane against the sidewall of the slot, and the longitudinal force may press the vane against the cam surface. For example, a width of the slot may be sized such that the working fluid applies the lateral force against a side (e.g., face) of the vane, thereby forcing the vane into contact with the sidewall of the slot. Additionally, an end of the vane not in contact with the cam surface may be spaced apart from a bottom of the slot. This spacing creates a clearance (e.g., gap) in which the working fluid flows around the side of the vane and forces the vane into contact with the cam surface. As such, the vane may not "bottom out" within the slot, but a gap distance may be interposed between an end of the vane and an end of the slot to allow the working fluid to apply the longitudinal force to the cam surface.

Additionally, as noted above, the vanes are biased towards the cam surface via springs. However, the pressure created by the working force assists in sealing the vanes against rotor as well as the cam surface. The pressure-assist provided by the working fluid reduces an amount of friction between the vanes and the cam surface, and consequently, reduces an amount of wear experienced by the vanes and/or the cam surface. Further, the amount of sealing force against the sidewall of the slot and the cam surface varies based on the pressures experienced within the chambers. For example, during high pressure applications, a high amount of force is needed to seal the vane against the rotor and the cam surface. As such, when high pressures are experienced within the chambers, this high pressure assists in sealing the vanes. Comparatively, during lower pressure applications, a less amount of force is needed to seal the vane against the rotor and the cam surface. The pressure-assist provided by the shape and size of the slot serves to improve sealing between the rotor, cam surface, and vane, respectively. As the pressure varies within the chambers, a corresponding amount of force that is utilized to seal the vane against the rotor and the cam surface correspondingly changes.

Therefore, in light of the above, the rotary device includes seals that seal the stator and the rotor to prevent leakage of working fluid from the chambers. The seals reduce an amount of friction between the rotor, stator, and/or vanes, as well as wear experienced by the rotor, stator, and/or vanes. Additionally, the vane actuate to compensate for corresponding pressures experienced within the chambers. This automatic compensation reduces an amount of wear experienced by the rotary device.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting examples. The features illustrated or described in connection with one example may be combined with the features of other examples. Such modifications and variations are intended to be included within the scope of the appended claims.

FIG. 1 illustrates an example rotary device 100. In some instances, the rotary device 100 may be configured as a compressor, expander, pump, or engine. In some instances, the rotary device 100 may include two housings, such as a first housing 102 and a second housing 104. As discussed herein, in some instances, the first housing 102 and the second housing 104 may enclose one or more rotor(s) and/or one or more stator(s). In this sense, the first housing 102 and the second housing 104 may define a shell, cover, or casing of the rotary device 100. In some instances, during operation, the first housing 102 and/or the second housing 104 may remain stationary. In other instances, the first housing 102 and/or the second housing 104 may rotate.

The rotary device 100 is shown including a shaft 106. As will be discussed herein, the rotor(s) may couple to the shaft 106 such that the rotor(s) rotate during rotation of the shaft 106, vice versa. For example, the shaft 106 may rotate about a longitudinal axis 108 (X-axis). The stator(s), however, may remain stationary during rotation of the rotor(s). In some instances, the rotor(s) may be coupled to the shaft 106 via press-fit(s), welds, and the like, while the stator(s) may couple to the shaft 106 via bearing(s), bushing(s), and the like. However, in some instances, the rotor(s) may remain stationary and the stator(s) may rotate. Although not shown, the shaft 106 may couple to one or more drive(s), gear(s), differential(s), generator(s), transmission(s), and the like for producing work. For example, rotation of the shaft 106 may be used to generate electricity, power drive train(s), and the like.

The rotary device 100 may include a first end 110 and a second end 112, spaced apart from the first end 110. The shaft 106, extending from the rotary device 100 at the second end 112, however, the shaft 106 may extend from the first end 110 and/or the second end 112 of the rotary device 100. In some instances, the first housing 102 and/or the second housing 104 may include one or more first ports 114 for providing a working fluid into the rotary device 100 (e.g., inlet ports) and/or discharging the working fluid (e.g., outlet ports), respectively. The first ports 114 may also be used for routing lubricants, coolant, and/or or other fluids.

Figure 2:
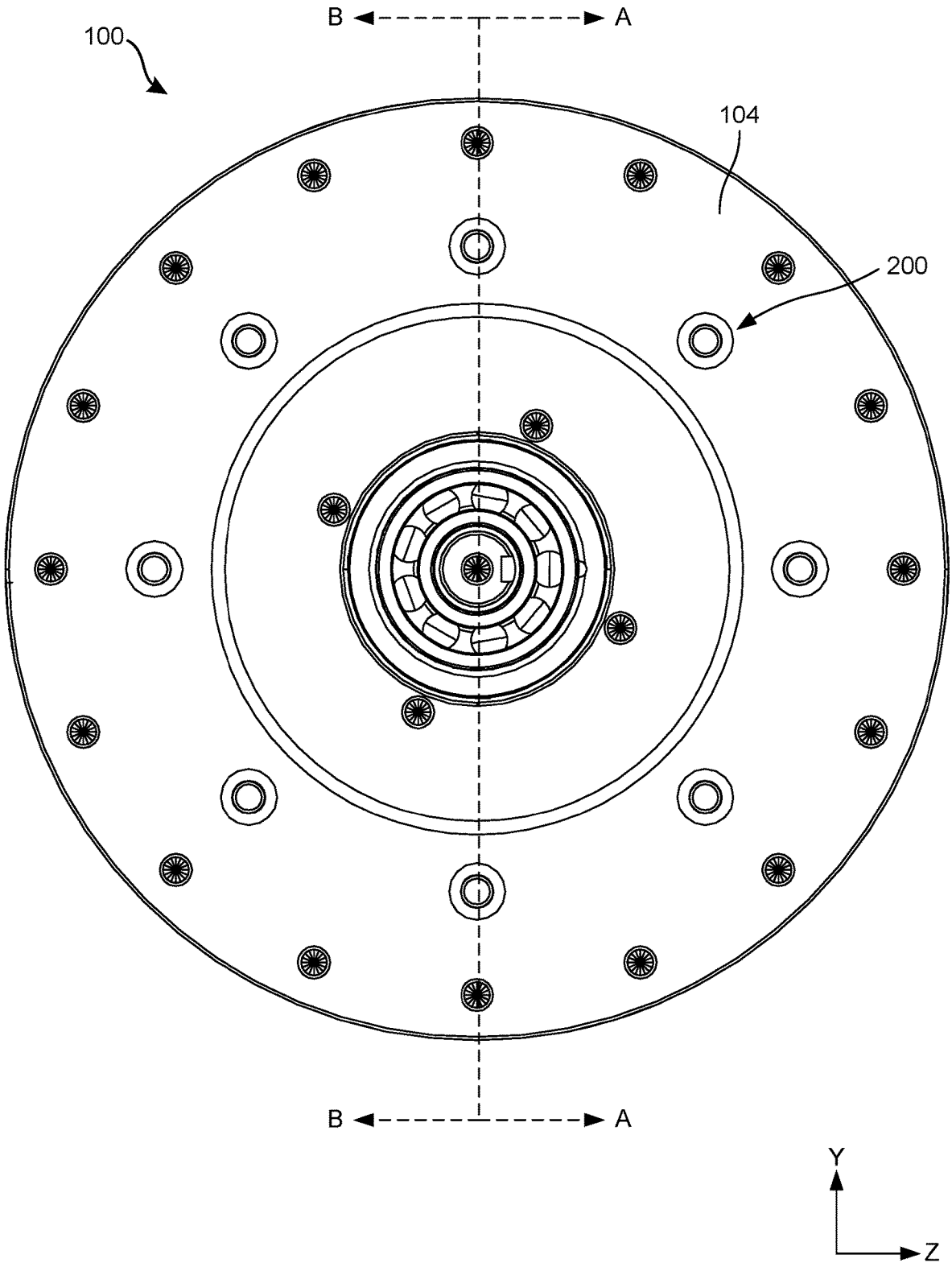
FIG. 2 illustrates an end view of the rotary device of FIG. 1, accordance to an example of the present disclosure.

FIG. 2 illustrates an end view of the second end 112 of the rotary device 100. As shown, the rotary device 100 may generally include a circular shape defined by the first housing 102 and/or the second housing 104. However, the rotary device 100 may include other shapes (e.g., hexagonal, square, etc.). The second housing 104 is shown including one or more second port(s) 200. In some instances, the second port(s) 200 may represent one or more inlet ports for providing a working fluid into the rotary device 100 and/or one or more outlet ports for discharging the working fluid. The second port(s) 200 may also be used for routing lubricants, coolant, and/or or other fluids into and/or out of the rotary device 100. The second port(s) 200 may additionally or alternatively be located on other sides and/or surfaces of the first housing 102 and/or the second housing 104, such as on a same side/surface as the first port(s) 114.

As also shown, FIG. 2 illustrates a line A-A and a line B-B extending through the rotary device 100. Line A-A and line B-B are used to illustrate cross-sectional views of the rotary device 100, which are discussed herein.

Figure 3:
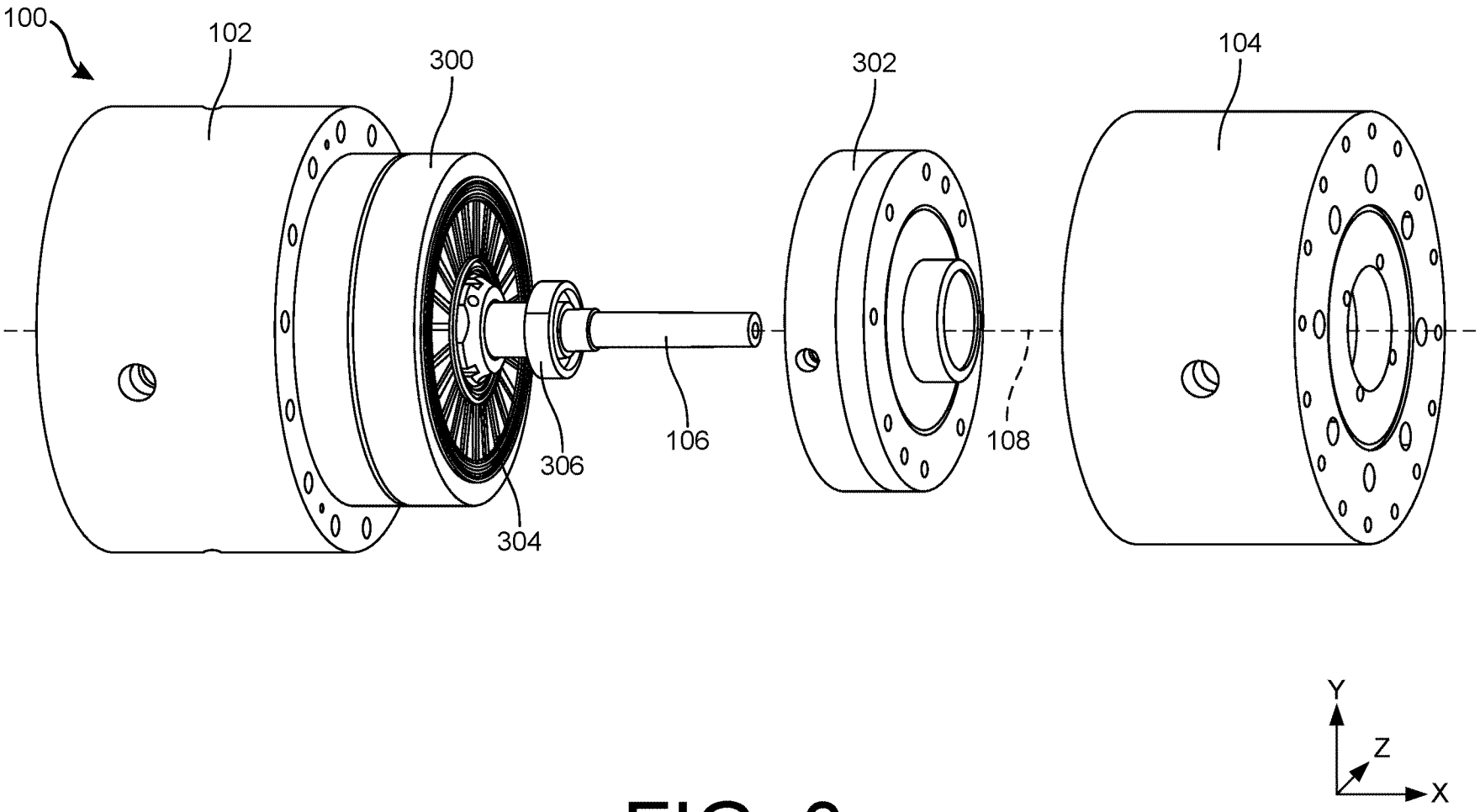
FIG. 3 illustrates a partially exploded view of the rotary device of FIG. 1, according to an example of the present disclosure.

FIG. 3 illustrates a partially exploded view of the rotary device 100. The rotary device 100 is shown being exploded in a direction along the longitudinal axis 108. More particularly, the second housing 104 is shown being separated from the first housing 102. The second housing 104 may enclose a rotor 300 and a stator 302. In other words, when assembled, the second housing 104 may reside over the rotor 300 and the stator 302. The second housing 104 may include cavity for receiving the rotor 300 and the stator 302. Likewise, the first housing 102 may include a cavity for receiving rotor(s) and stator(s).

The rotor 300 is shown being coupled to the shaft 106. As will be discussed herein, the rotor 300 includes a plurality of slots that receive vanes 304, respectively. The vanes 304 are configured to translate within the slots, in a direction along the longitudinal axis 108, as the vanes 304 traverse a cam surface of the stator 302. That is, as the vanes 304 traverse along the cam surface, the vanes 304 retract into and extend out of the slots. As will also be discussed herein, labyrinth seals may be used to seal an interface between the rotor 300 and the stator 302.

The stator 302 may operably couple to the shaft 106 via a bearing 306. As the rotor 300 and the shaft 106 rotate, the bearing 306 allows the stator 302 to remain stationary. As noted above, in some instances, the first housing 102 and/or the second housing 104 may remain stationary during rotation of the rotor 300 and the shaft 106.

Figure 4:
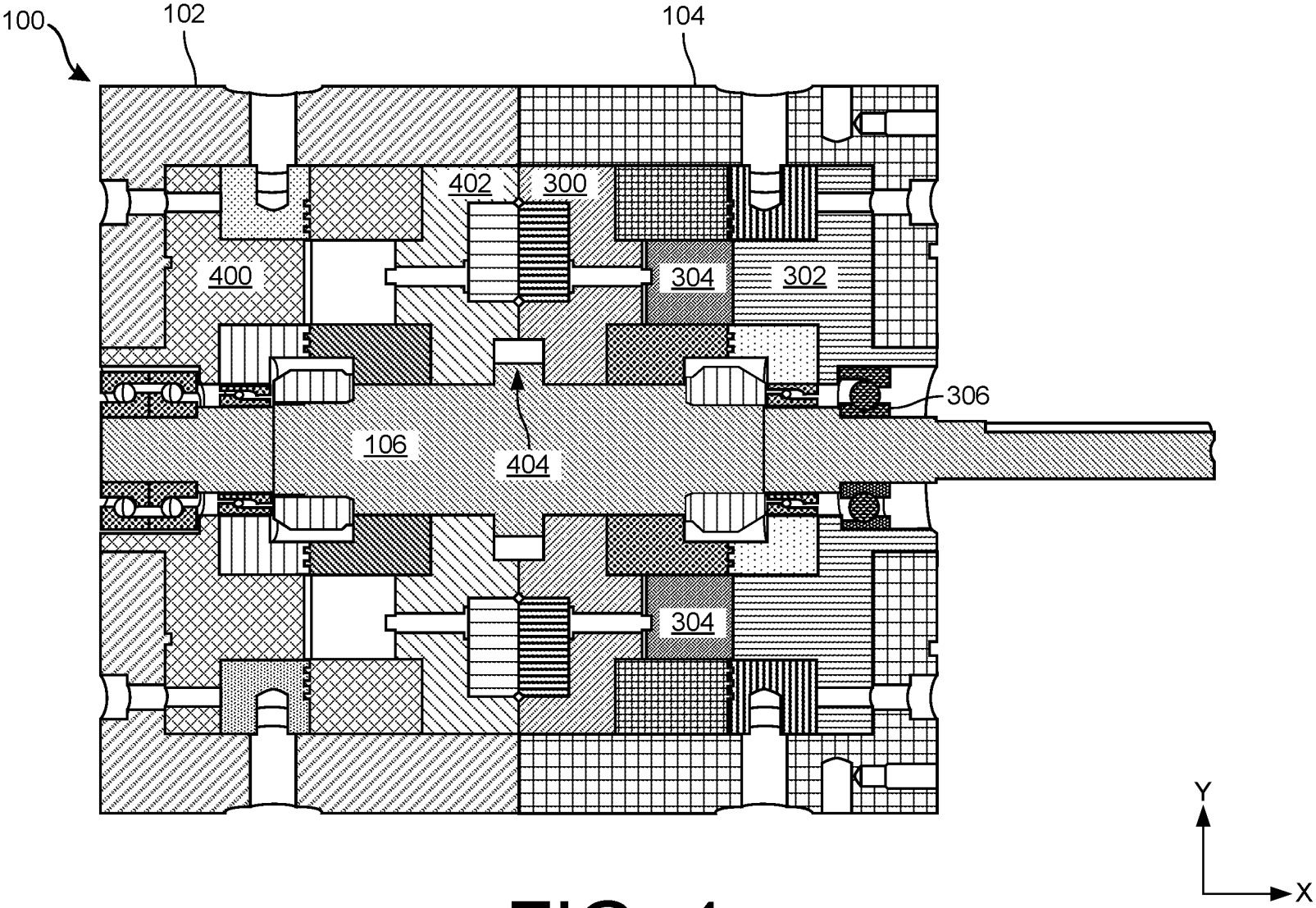
FIG. 4 illustrates a cross-sectional view of the rotary device of FIG. 1, taken along line A-A of FIG. 2, according to an example of the present disclosure.

FIG. 4 illustrates a cross-sectional view of the rotary device 100, taken along line A-A of FIG. 2. The second housing 104 is shown encasing, or surrounding, the rotor 300 and the stator 302. Additionally, the first housing 102 may encase, or surround, a rotor 400 and a stator 402. In other words, FIG. 4 (as well as other figures herein) illustrate that the rotary device 100 may include more than one rotor and more than one stator. In such instances, the rotors may include respective vanes that axially translate therein and which respectively engage with cam surfaces of the stators. The rotor 300 and the rotor 400, however, may couple to the shaft 106 and rotate. However, the discussion herein relates the operation and function of the rotor 300 and the stator 302. The rotor 400 and the stator 402 may function similarly and include similar components as the rotor 300 and the stator 302, respectively. Additionally, the rotary device 100 may include more rotors and/or stators than shown (e.g., three, four, etc.), or less rotors and stators than shown (e.g., one).

In some instances, the use of multiple rotor(s) and stator(s) may serve to balance the rotary device 100. In other words, the rotor 400 and the stator 402 (as well as vanes in contact therewith), may counterbalance the rotor 300, the stator 302, and the vanes 304 during operation. In some instances, the rotor 300 and the rotor 400 are rotated such that chambers are directly aligned with each other, thereby balancing the pressure loads within the rotary device 100.

The rotor 300 is shown coupled to the shaft 106. In some instances, the rotor 300 fixedly couples to the shaft 106 via press-fit, welds, fastener(s), and the like. The shaft 106 may include a notch 404 against which the rotor 300 abuts. Meanwhile, the bearing 306 may operably couple the stator 302 to the shaft 106. The vanes 304 are shown residing within a space, volume, area, or chamber between the rotor 300 and the stator 302. The vanes 304 are shown extending from the rotor 300 for engaging with an undulating cam surface of the stator 302 (as discussed herein). As also discussed herein, seal(s) may couple to the rotor 300 and the stator 302 for defining the chambers as well as sealing the chambers.

In some instances, other components of the rotary device 100 may form tortuous paths to prevent leakage of the working fluid from the rotary device 100. For example, the bearing 306, other bushings, gaskets, and so forth coupled to the shaft 106 may form a torturous path and prevent working fluid leaking to an environment of the rotary device 100.

Figure 5:
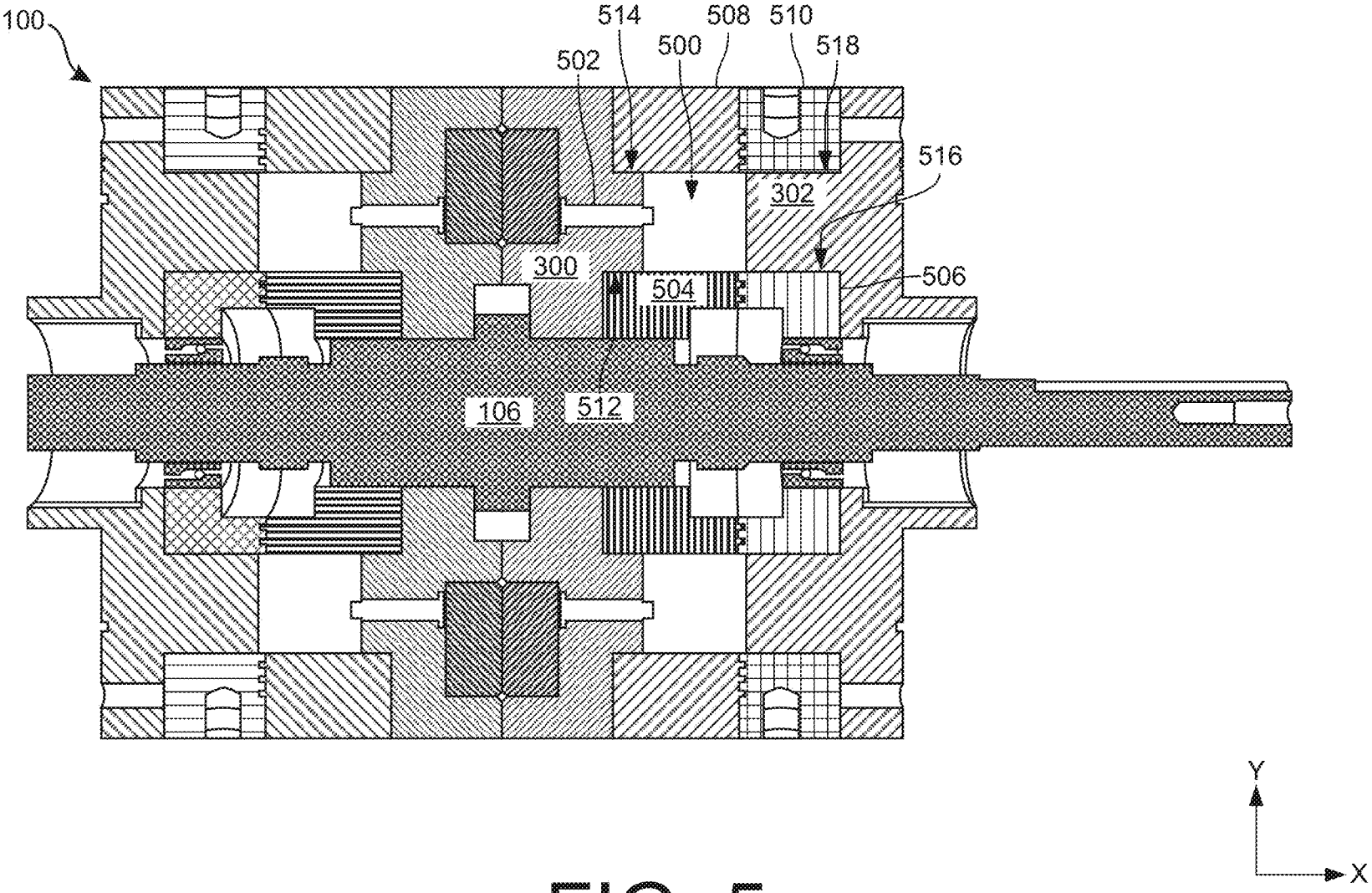
FIG. 5 illustrates a partial cross-sectional view of the rotary device of FIG. 1, taken along line A-A of FIG. 2, showing a housing of the rotary device removed, according to an example of the present disclosure.

FIG. 5 illustrates a cross-sectional view of the rotary device 100, taken along line A-A of FIG. 2. In FIG. 5, the first housing 102, the second housing 104, and the vanes 304 are shown removed.

The rotor 300 and the stator 302 at least partially define chambers 500 of the rotary device 100. Generally, the chambers 500 represent a space within which the working fluid (e.g., oil, gas, vapor, etc.) is received and compressed, expanded, pumped, etc. As the rotor 300 rotates, a volume of the chambers 500 decreases or increases to provide the compressing, expanding, and/or pumping action. A biasing member 502, such as a spring, gas cylinder, and the like, biases the vanes 304 in a direction towards the stator 302. The biasing nature of the biasing member 502 serves to maintain contact between the vane 304 and the stator 302, thereby sealing the chambers 500 and the working fluid within the chambers 500. The rotor 300 (or a body thereof) includes passages for receiving the biasing member 502.

The chambers 500 are also defined at least in part by a first seal 504, a second seal 506, a third seal 508, and a fourth seal 510. The first seal 504 and the third seal 508 are shown coupled to the rotor 300. For example, the first seal 504 may couple to a first surface or side 512 of the rotor 300, and the third seal 508 may couple to a second surface or side 514 of the rotor 300. Therefore, the first seal 504 and the third seal 508 may rotate during a rotation of the rotor 300. In some instances, the rotor 300, the first seal 504, and the third seal 508 may represent a rotor assembly. In some instances, the first seal 504 and the third seal 508 represent rings or disc-like structures that are coupled to the rotor 300. For example, the first seal 504 and the third seal 508 may be press-fit onto the rotor 300. In some instances, the first seal 504 and the third seal 508 may be components of the rotor 300. As also shown, the first seal 504 and the third seal 508 may define one or more sides of the chambers 500, such as lateral sides of the chambers 500. The first seal 504 and the third seal 508 annularly extend around the rotor 300, and the first seal 504 may reside within the third seal 508.

The second seal 506 and the fourth seal 510 are shown coupled to the stator 302. For example, the second seal 506 may couple to a first surface or side 516 of the stator 302, and the fourth seal 510 may couple to a second surface or side 518 of the stator 302. In some instances, the stator 302, the second seal 506, and the fourth seal 510 may represent a stator assembly. The second seal 506 and the fourth seal 510 may remain stationary with the stator 302 during a rotation of the rotor 300. In some instances, the second seal 506 and the fourth seal 510 represent rings or disc-like structures that are coupled to the stator 302. For example, the second seal 506 and the fourth seal 510 may be press-fit onto the stator 302. In some instances, the second seal 506 and the fourth seal 510 may be components of the stator 302. As also shown, the second seal 506 and the fourth seal 510 may define one or more sides of the chambers 500, such as lateral sides of the chambers 500. The second seal 506 and the fourth seal 510 annularly extend around the stator 302, and the second seal 506 may reside within the fourth seal 510.

The first seal 504 and the second seal 506 are configured to form a first labyrinth seal, between at interface of the rotor 300 and the stator 302. For example, as will be discussed herein, the first seal 504 may include protrusions, projections, serrations, grooves and so forth that are complimentary with protrusions, projections, serrations, grooves and so forth of the second seal 506. Collectively, the first seal 504 and the second seal 506 form a tortuous path to prevent the working fluid within the chambers 500 leaking to an environment of the rotary device 100. (in a direction substantially orthogonal to the longitudinal axis 108) or between adjacent chambers. As shown, the first seal 504 and the second seal 506 may be located proximate the shaft 106, so as to define an inner side of the chambers 500.

The third seal 508 and the fourth seal 510 are configured to form a second labyrinth seal, between an interface of the rotor 300 and the stator 302. For example, as will be discussed herein, the third seal 508 may include protrusions, projections, serrations, grooves and so forth that are complimentary with protrusions, projections, serrations, grooves and so forth of the fourth seal 510. Collectively, the third seal 508 and the fourth seal 510 form a tortuous path to prevent the working fluid within the chambers 500 leaking to the environment of the rotary device 100 (in a direction substantially orthogonal to the longitudinal axis 108) or between adjacent chambers . As shown, the third seal 508 and the fourth seal 510 may be located distant the shaft 106, as compared to the first seal 504 and the second seal 506, so as to define an outer side of the chambers 500.

The rotary device 100 may include injection port(s) and exhaust port(s) (e.g., the first port(s) 114 and/or the second port(s) 200). In some instances, the injection port(s) and the exhaust port(s) are disposed through the stator 302 so as to supply the working fluid into the chambers 500, and eject the working fluid from the chambers 500 (e.g., once compressed, expanded, etc.). Any number of injection port(s) and exhaust port(s) may be included.

Figure 6:
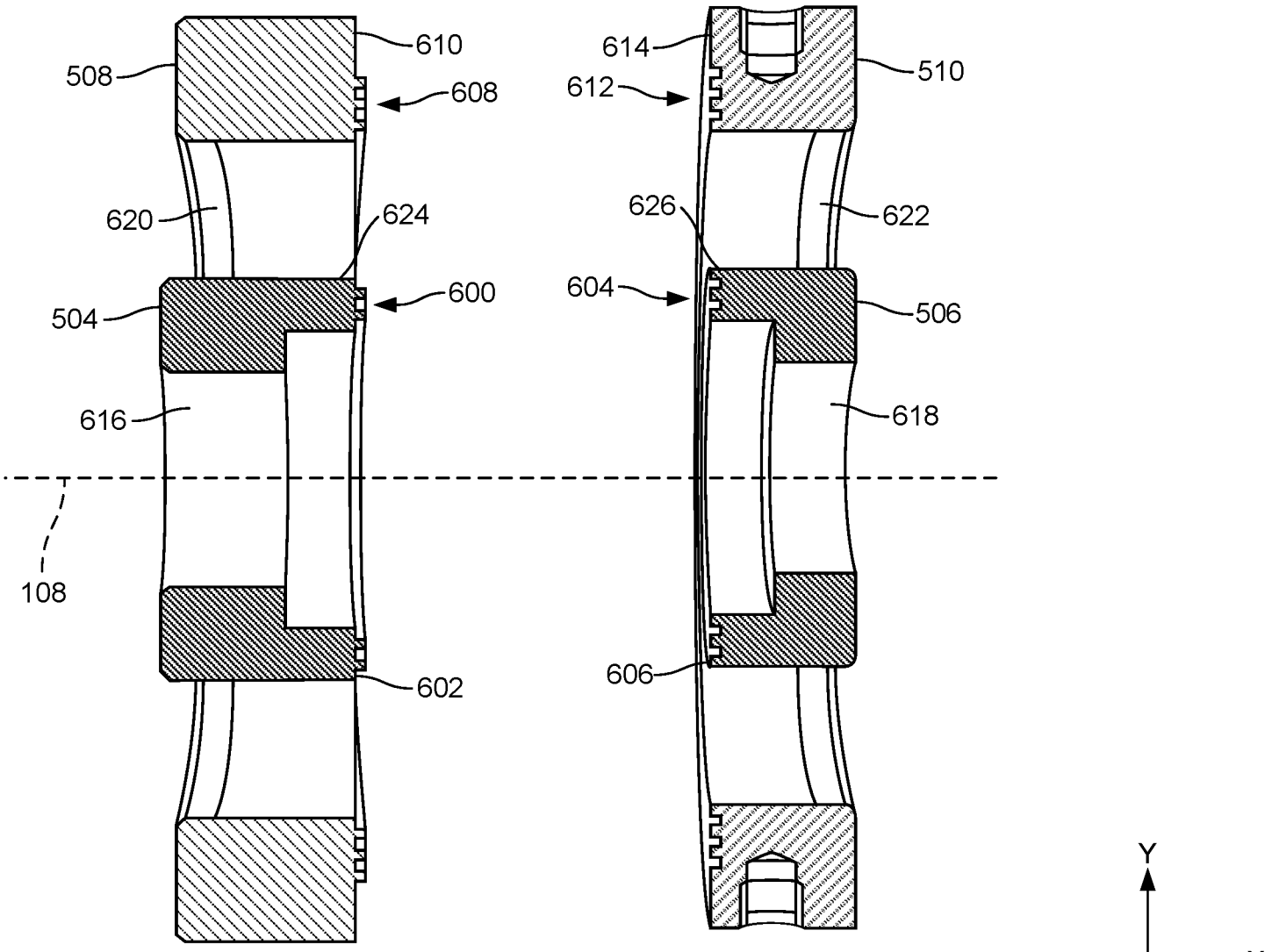
FIG. 6 illustrates a partial cross-sectional view of the rotary device of FIG. 1, taken along line A-A of FIG. 2, showing example seals of the rotary device, according to an example of the present disclosure.

FIG. 6 illustrates a detailed cross-sectional view of the first seal 504, the second seal 506, the third seal 508, and the fourth seal 510, taken along line A-A of FIG. 2. The first seal 504 is shown spaced apart from the second seal 506 to illustrate grooves of the first seal 504 and the second seal 506, respectively, that form the first labyrinth seal. Similarly, the third seal 508 is shown spaced apart from the fourth seal 510 to illustrate grooves of the third seal 508 and the fourth seal 510, respectively, that form the second labyrinth seal.

As discussed above, the first seal 504, the second seal 506, the third seal 508, and the fourth seal 510 may represent ring-like structures. The first seal 504 and the third seal 508 may couple to the rotor 300, or may represent components of the rotor 300, while the second seal 506 and the fourth seal 510 may couple to the stator 302, or represent components of the stator 302.

The first seal 504 is shown including first grooves 600. The first grooves 600 annularly extend around the first seal 504, about the longitudinal axis 108. The first grooves 600 may extend from a first surface 602 of the first seal 504, in a direction along the longitudinal axis 108. The second seal 506 is shown including second grooves 604 that are complimentary to or with the first grooves 600. A second surface 606 of the second seal 506 may define the second grooves 604, where the second grooves 604 are formed within the second surface 606. Likewise, the second grooves 604 may extend into the second surface 606 in a direction along the longitudinal axis 108.

The first seal 504 may include a corresponding number of first grooves 600 as the second grooves 604 of the second seal 506, vice versa. For example, the first grooves 600 may fit or otherwise reside within the second grooves 604. In this manner, the first grooves 600 and the second grooves 604 may form a male-female engagement to provide the tortuous path of the first labyrinth seal. As shown, the first seal 504 may include two first grooves 600, while the second seal 506 may include two second grooves 604 for receiving the two first grooves 600 of the first seal 504. Once assembled, and during rotation of the rotor 300 (and therefore the first seal 504), the first grooves 600 may rotate about the longitudinal axis 108 and within the second grooves 604. However, in order to prevent frictional losses and wear, the first grooves 600 and the second grooves 604 may include sufficient tolerances such that the first grooves 600 and the second grooves 604 do not rub, abut, or otherwise contact.

The third seal 508 is shown including third grooves 608. The third grooves 608 annularly extend aground the third seal 508, about the longitudinal axis 108. The third grooves 608 may extend from a third surface 610 of the first seal 504, in a direction along the longitudinal axis 108. The fourth seal 510 is shown including fourth grooves 612 that are complimentary to or with the third grooves 608. A fourth surface 614 of the fourth seal 510 may define the fourth grooves 612, where the fourth grooves 612 are formed within the fourth surface 614. Likewise, the fourth grooves 612 may extend into the fourth surface 614 in a direction along the longitudinal axis 108.

The third seal 508 may include a corresponding number of third grooves 608 as the fourth grooves 612 of the fourth seal 510, vice versa. For example, the third grooves 608 may fit or otherwise reside within the fourth grooves 612. In this manner, the third grooves 608 and the fourth grooves 612 may form a male-female engagement to provide the tortuous path of the second labyrinth seal. As shown, the third seal 508 may include three third grooves 608, while the fourth seal 510 may include three fourth grooves 612 for receiving the three third grooves 608 of the first seal 504. Once assembled, and during rotation of the rotor 300 (and therefore the third seal 508), the third grooves 608 may rotate about the longitudinal axis 108 and within the fourth grooves 612. However, in order to prevent frictional losses and wear, the third grooves 608 and the fourth grooves 612 may include sufficient tolerances such that the third grooves 608 and the fourth grooves 612 do not rub, abut, or otherwise contact.

The first seal 504 is shown including a first interior surface 616 that may couple to the shaft 106. The second seal 506 is also shown including a second interior surface 618 that may couple or otherwise engage with the bearing 306. The third seal 508 is shown including a third interior surface 620 that may couple to the rotor 300. The fourth seal 510 is shown including a fourth interior surface 622 that may couple to the stator 302. The third interior surface 620 of the third seal 508 and the fourth interior surface 622 of the fourth seal 510 may at least partially define the chambers 500 once the rotary device 100 is assembled. Additionally, the chambers 500 may be defined by a first outer surface 624 of the first seal 504 and a second outer surface 626 of the second seal 506.

Although the first seal 504, the second seal 506, the third seal 508, and the fourth seal 510 are shown including a certain number of grooves, the first seal 504, the second seal 506, the third seal 508, and the fourth seal 510 may include a different number of grooves than shown. Additionally, in some instances, the number of grooves of the first seal 504, the second seal 506, the third seal 508, and the fourth seal 510 may be based on a working fluid within the chambers 500, pressures within the chambers 500, a rotational speed of the rotor 300, and/or other factors. However, the second seal 506 may include a corresponding number of the second grooves 604 to receive the first grooves 600. Additionally, the fourth seal 510 may include a corresponding number of the fourth grooves 612 to receive the third grooves 608

Moreover a depth (X-direction) and/or a width (Y-direction) of the grooves of the first seal 504, the second seal 506, the third seal 508, and the fourth seal 510 may be based on such factors as well. In some instances, although some of the grooves of the first seal 504, the second seal 506, the third seal 508, and the fourth seal 510 are shown extending from surfaces thereof, while other grooves of the first seal 504, the second seal 506, the third seal 508, and the fourth seal 510 may be formed within surfaces thereof, other embodiments are envisioned. For example, the first grooves 600 may be formed within the first surface 602, and the second grooves 604 may extend from the second surface 606.

In some instances, the first seal 504 and the second seal 506 may be made of similar materials, or different materials, and/or the third seal 508 and the fourth seal 510 may be made of similar materials, or different materials. Example materials include ceramics, engineering composites, metal, plastic, etc. In some instances, the materials may be based on the working fluid and/or operating parameters of the rotary device 100 (e.g., speed, size, etc.). Additionally, or alternatively, the first seal 504, the second seal 506, the third seal 508, and the fourth seal 510 may be coated, uncoated, or surface finished.

As also shown in FIG. 6, the first seal 504 may include a diameter that is smaller than a diameter of the third seal 508. The third seal 508 is disposed around an outside diameter or outside perimeter of the chambers 500, while the first seal 504 is disposed around an inside diameter or inside perimeter of the chambers 500. Likewise, the second seal 506 may include a diameter that is smaller than a diameter of the fourth seal 510. The fourth seal 510 is disposed around an outside diameter or outside perimeter of the chambers 500, while the second seal 506 is disposed around an inside diameter or inside perimeter of the chambers 500. In some instances, the diameter of the first seal 504 and the second seal 506 may be similar or different, and/or the diameter of the third seal 508 and the fourth seal 510 may be similar or different.

Figure 7:
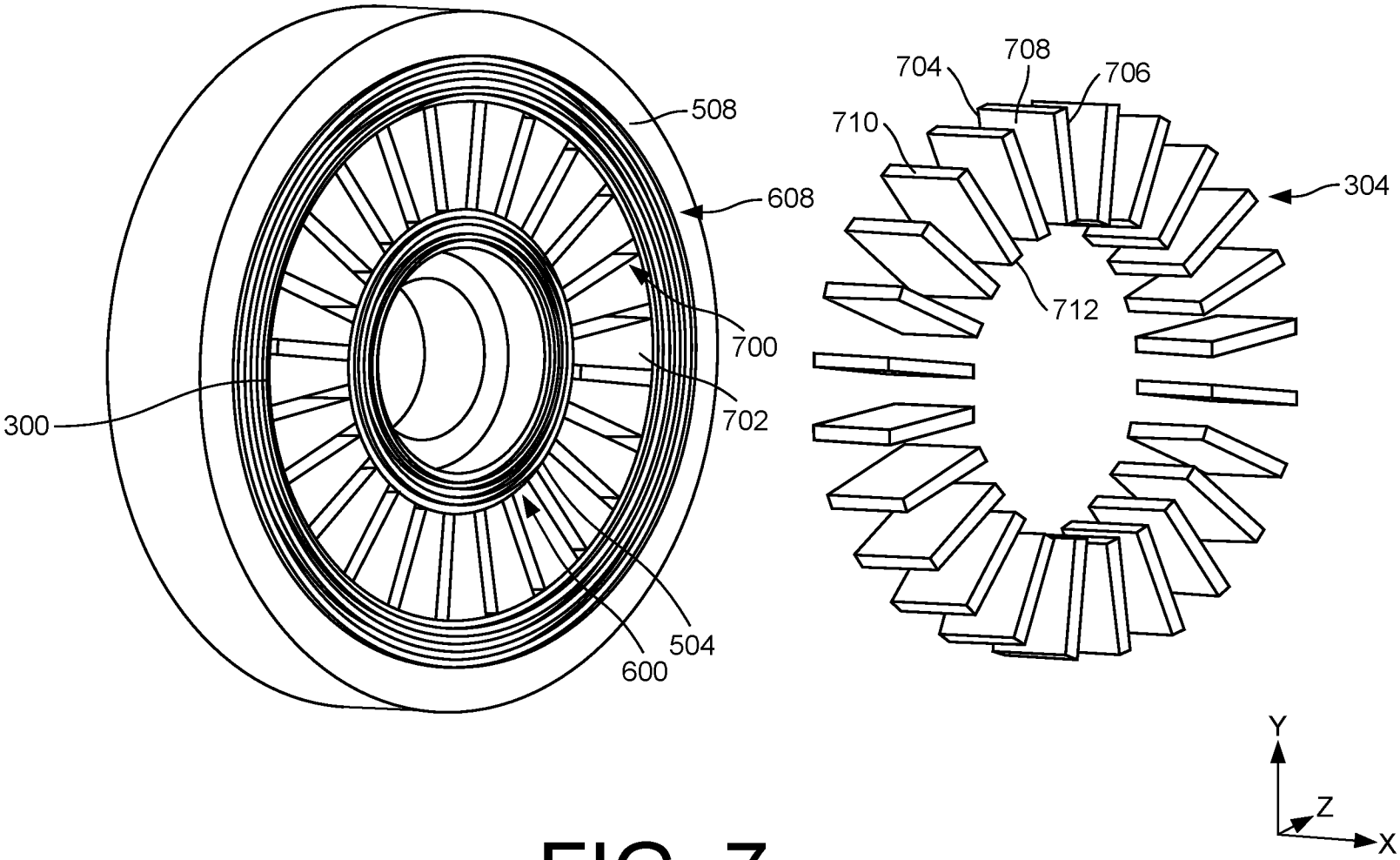
FIG. 7 illustrates an exploded view of an example rotor and example vanes of the rotary device of FIG. 1, where the vanes are received at least partially within slots of the rotor, according to an example of the present disclosure.

FIG. 7 illustrates the rotor 300, the vanes 304, the first seal 504, and the third seal 508. As illustrated, the first seal 504 and the third seal 508 are shown coupled to the rotor 300 (e.g., press-fit). The first grooves 600 of the first seal 504 are shown annularly extending around the first seal 504 (about the longitudinal axis 108). Similarly, the third grooves 608 of the third seal 508 are shown annularly extending around the third seal 508 (about the longitudinal axis 108).

The rotor 300 is shown defining a plurality of channels, receptacles, or slots 700 for receiving the vanes 304, respectively. The slots 700 may be formed within the rotor 300 and extend through a thickness of the rotor 300 (X-direction). The slots 700 are shown located, with the rotor 300, between the first seal 504 and the third seal 508. The slots 700 may be evenly spaced apart from one another around the rotor 300, around the longitudinal axis 108. The slots 700 are interposed between the first seal 504 and the third seal 508 such the first seal 504 and the third seal 508 seal the chambers 500, via the first grooves 600, the second grooves 604, the third grooves 608, and the fourth grooves 612. The rotor 300 is further shown including a surface 702, which may define at least part of the chambers 500 (e.g., top). A portion of the surface 702 is interposed between adjacent slots 700.

The slots 700 are sized and configured to receive the vanes 304, respectively. The vanes 304 may each include a distal end 704 and a proximal end 706. The distal end 704 of the vanes 304 may be inserted into the slots 700 (in the X-direction). When inserted, the distal end 704 may engage with the biasing member 502 so as to bias the vane toward the stator 302. Additionally, when inserted, the proximal end 706 of the vanes 304 may reside external to the slot 700, and spaced apart from the surface 702 of the rotor 300. Between the distal end 704 and the proximal end 706, the vanes 304 may include a body 708. At least a portion of the body 708 resides within the slots 700 during translation of the vane 304 into and out of the slot 700.

The vanes 304 also include a first lateral side 710 and a second lateral side 712. The first lateral side 710 may be configured to abut or engage the first seal 504 and the second seal 506 (or a surface thereof) to seal the chambers 500. For example, the first lateral side 710 may engage the third interior surface 620 and the fourth interior surface 622. The second lateral side 712 may be configured to abut the third seal 508 and the fourth seal 510 (or a surface thereof) to seal the chambers. For example, the second lateral side 712 may engage the first outer surface 624 and the second outer surface 626.

The first seal 504 and the third seal 508 are shown being concentric with one another, about the longitudinal axis 108. Additionally, as shown the third seal 508 may annularly extend around first seal 504, so as to encircle or be disposed over the first seal 504.

Although a particular number of vanes 304 are shown, the rotary device 100 may be configured with any number of vanes 304. For example, FIG. 7 illustrates twenty four vanes 304 and twenty four corresponding slots 700. In some instances, the rotary device 100 may include a smaller number of vanes 304 and slots 700 (e.g., twelve) or a greater number of vanes 304 and slots 700 (e.g., thirty six).

Figure 8:
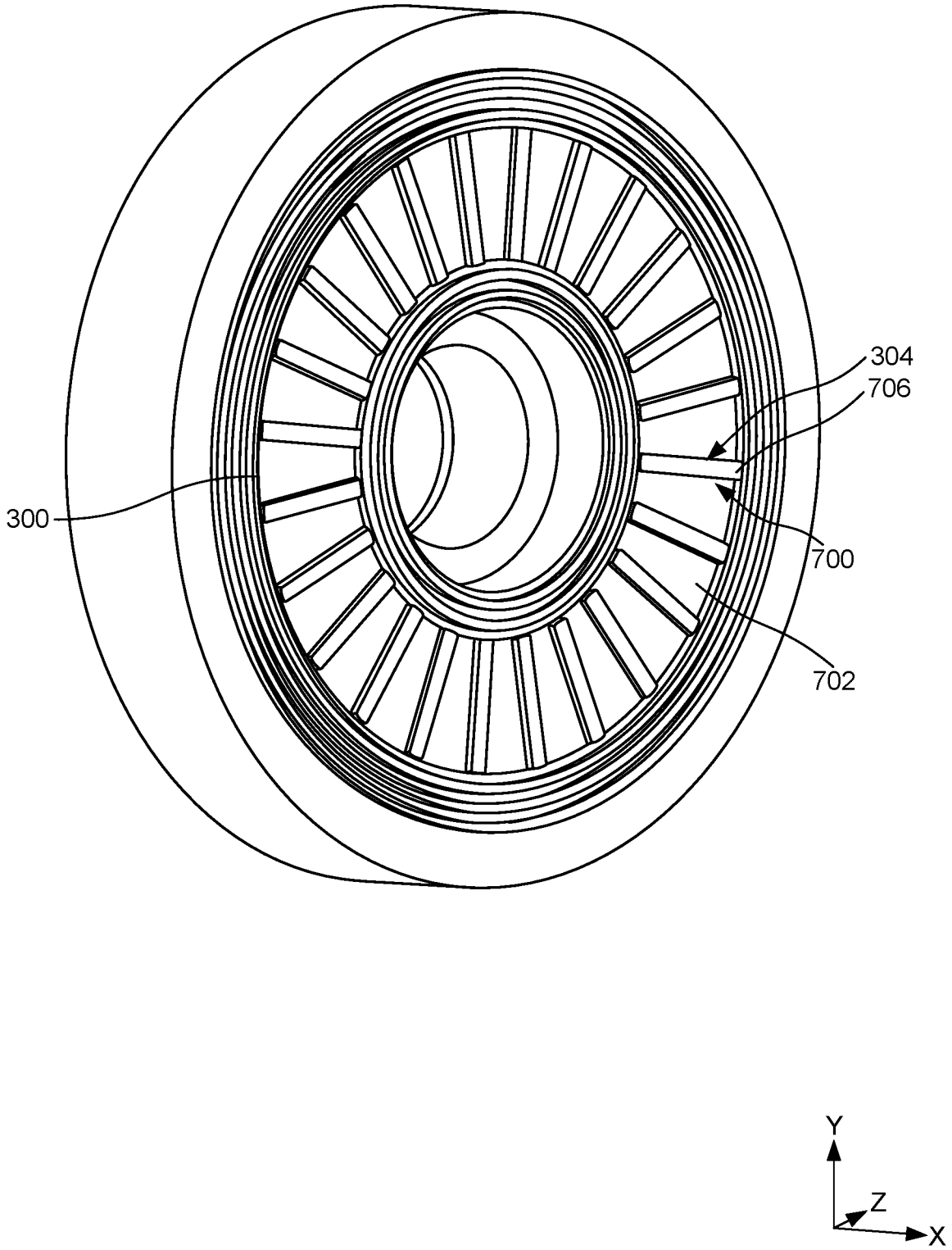
FIG. 8 illustrates the vanes of FIG. 7 received at least partially within the slots of the rotor of FIG. 7, according to an example of the present disclosure.

FIG. 8 illustrates an assembled view, showing the vanes 304 residing within the slots 700. When the vanes 304 are inserted into the slots 700, at least a portion of the vanes 304 resides external to the slots 700 for engaging with the stator 302. For example, the proximal end 706 may be disposed external to the slots 700, and above the surface 702 (X-direction).

As introduced above, the surface 702 of the rotor 300 may define a portion of the chambers 500. For example, between adjacent vanes 304, chambers 500 are formed and within the chambers 500, a working fluid is compressed, expanded, pumped, and so forth. In addition to the vanes 304 defining the chambers 500, such as between adjacent faces of the vanes 304, the surface 702 of the rotor 300 defines the chambers 500 (e.g., an end of the chambers 500).

Figure 9:
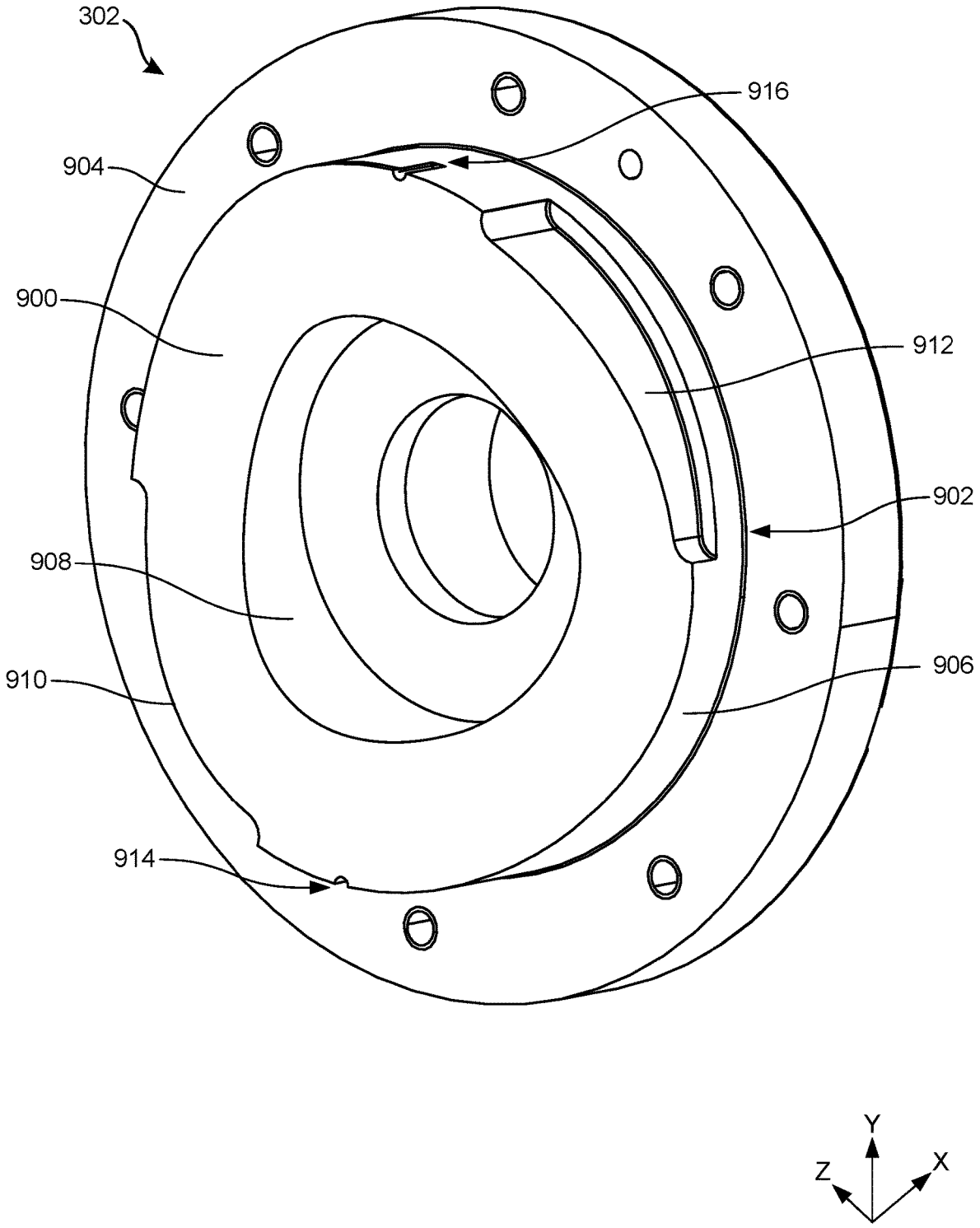
FIG. 9 illustrates an example stator of the rotary device of FIG. 1, according to an example of the present disclosure.

FIG. 9 illustrates a perspective view of the stator 302, showing the second seal 506 and the fourth seal 510 removed. The stator 302 is show including a cam surface 900 that undulates in the X-direction, and about the longitudinal axis 108. In some instances, the cam surface 900 represent a surface of a cam 902 that extends from a flange 904 of the stator 302 (in the X-direction). The second seal 506 and/or the fourth seal 510 may abut against the flange 904 when the second seal 506 and the fourth seal 510 couple to the stator 302, respectively. Additionally, when coupled to the stator 302, the fourth interior surface 622 of the fourth seal 510 may adjoin or otherwise couple to an outer surface 906 of the cam 902. For example, the fourth interior surface 622 of the fourth seal 510 may reside over the outer surface 906 of the cam 902.

The cam 902 also includes an inner surface 908 that engages with the second seal 506. For example, the second outer surface 626 of the second seal 506 may couple to the inner surface 908, such that the first seal 504 resides within a perimeter of the inner surface 908.

A first channel 910 and a second channel 912 are formed within the cam surface 900 and extend in a direction into the cam 902. The first channel 910 and the second channel 912 may also be formed in the outer surface 906. As discussed herein, the first channel 910 and the second channel 912 fluidly connect to one or more outlet ports for exhausting working fluid from the chambers 500. During rotation of the rotor 300 and the vanes 304, as the vanes 304 traverse over the cam surface 900 and come into fluid connection with the first channel 910 and the second channel 912, the working fluid may be channeled to the outlet port.

The cam surface 900 is also shown including a first inlet port 914 and a second inlet port 916. The first inlet port 914 and the second inlet port 916 may be formed into the cam surface 900, and route working fluid into the chambers 500 As shown, the first inlet port 914 and the second inlet port 916 may be located on diametrically opposed peaks of the cam 902.

Figure 10:
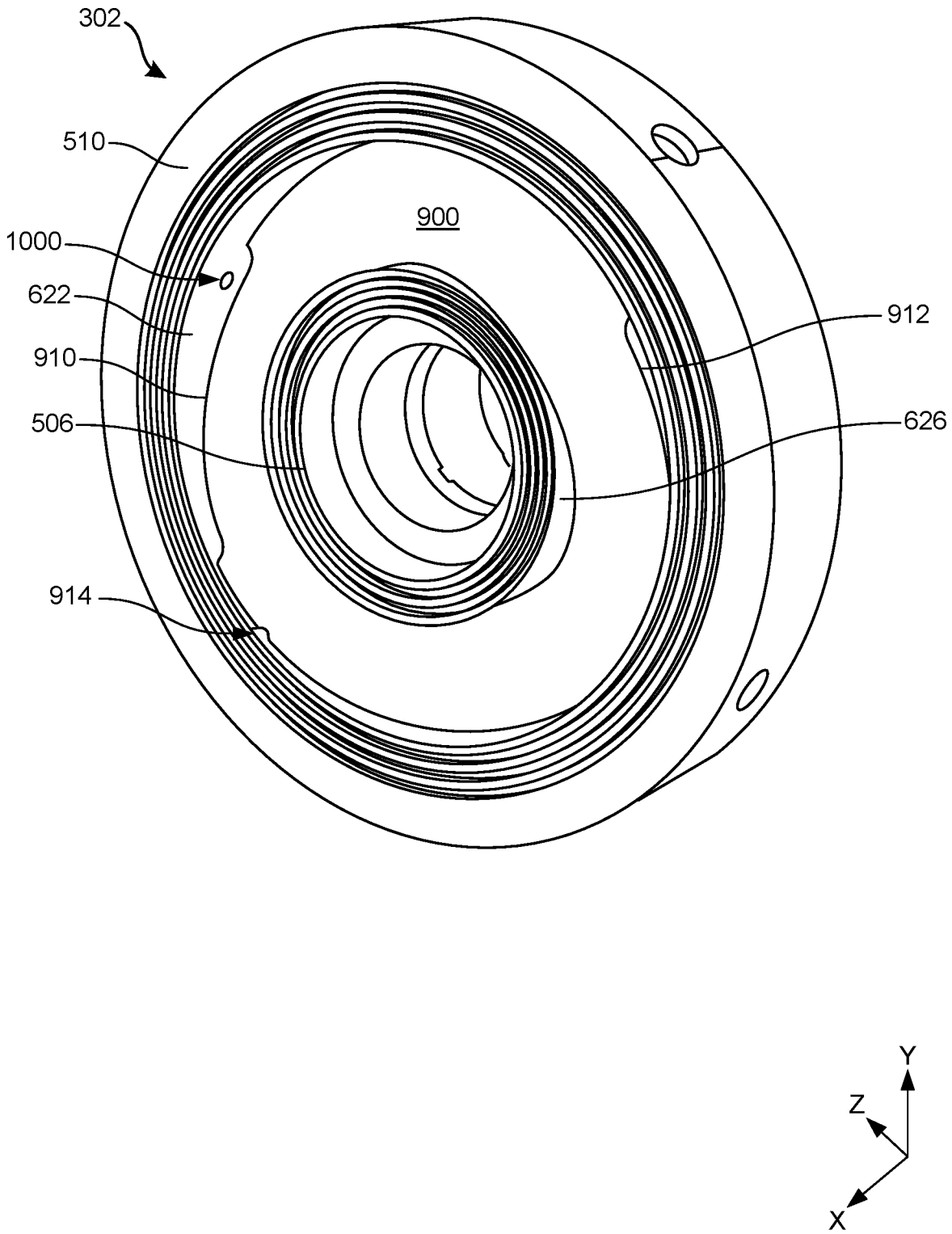
FIG. 10 illustrates a perspective view of the stator of FIG. 9 coupled to example seals of the rotary device of FIG. 1, according to an example of the present disclosure.

FIG. 10 illustrates a perspective view of the second seal 506 and the fourth seal 510 coupled to the stator 302. The second seal 506 is shown being disposed on an inside of the cam surface 900 (e.g., within a perimeter of the cam surface 900), while the fourth seal 510 is shown being disposed on an outside of the cam surface 900 (e.g., around the perimeter of the cam surface 900). For example, the second outer surface 626 of the second seal 506 may adjoin or couple to the inner surface 908 of the cam 902, and the fourth interior surface 622 of the fourth seal 510 may adjoin or couple to the outer surface 906 of the cam 902. Introduced above, the second seal 506 and the fourth seal 510 couple to the stator 302 to as least partially define the chambers 500 and seal the working fluid within the chambers 500.

As also shown, the fourth seal 510 may include a first outlet port 1000 formed through or within fourth interior surface 622. The first outlet port 1000 may expel or otherwise exhaust the working fluid, gases, and so forth from with the chambers 500. In some instances, the first outlet port 1000 is fluidly connected to the first channel 910 and/or disposed within the cam surface 900. For example, the first channel 910 may be formed within the cam surface 900 and the first outlet port 1000 may fluidly connect to the first channel 910. During rotation of the rotor 300 and the vanes 304, as the vanes 304 traverse over the cam surface 900 and come into fluid connection with the first channel 910, the working fluid may be channeled to the first outlet port 1000. As discussed herein, the fourth seal 510 may include another outlet port diametrically opposed from the first outlet port 1000, and the other outlet port may be fluidly connected to the second channel 912 formed within the cam surface 900.

Figure 11:
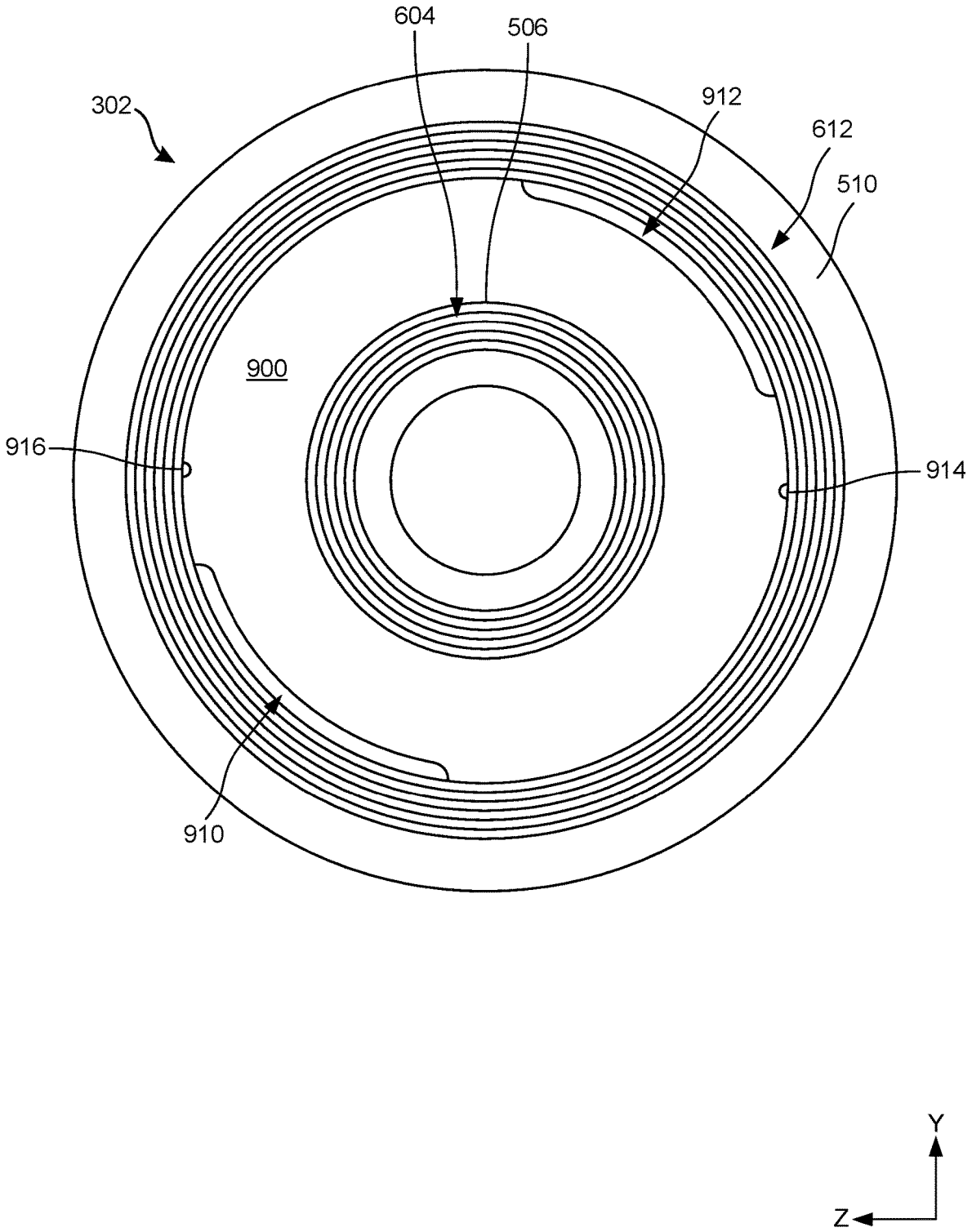
FIG. 11 illustrates a planar view of the stator of FIG. 9 coupled to example seals the rotary device of FIG. 1, according to an example of the present disclosure.

FIG. 11 illustrates a planar view of the second seal 506 and the fourth seal 510 coupled to the stator 302. As shown, the second grooves 604 of the second seal 506 annularly extend around the second seal 506, about the longitudinal axis 108. The second grooves 604 are complimentary to the first grooves 600 of the first seal 504 to form the first labyrinth seal. For example, the second grooves 604 may receive the first grooves 600. The fourth grooves 612 of the fourth seal 510 annularly extend around the fourth seal 510, about the longitudinal axis 108. The fourth grooves 612 are complimentary to the third grooves 608 of the third seal 508 to form the second labyrinth seal. For example, the fourth grooves 612 may receive the third grooves 608.

The cam surface 900, or more generally the cam 902, is interposed between the second seal 506 and the fourth seal 510. The cam surface 900 may be concentric with, and in between, the second seal 506 and the fourth seal 510. The cam surface 900 defines an end of the chambers 500, spaced apart from an end of the chambers 500 formed by the surface 702 of the rotor 300. In this sense, the surface 702 of the rotor 300 and the cam surface 900 may define longitudinal ends of the chambers 500, spaced apart in a direction along the longitudinal axis 108. The first outer surface 624 of the second seal 506 and the fourth interior surface 622 of the fourth seal 510 also define sides of the chambers 500.

As introduced above, the cam surface 900 is also shown defining, or including, the first channel 910 and/or the second channel 912. The first channel 910 and the second channel 912 are utilized to route the working fluid to the first outlet port 1000 and a second outlet port, respectively. During rotation of the rotor 300, as the vanes 304 pass over the first channel 910 and the second channel 912, the working fluid maybe routed within the first channel 910 and the second channel 912 and out the first outlet port 1000 and the second outlet port, respectively. The first inlet port 914 and the second inlet port 916 are also shown being formed within the cam surface 900. The first inlet port 914, the second inlet port 916, the first outlet port 1000, and the second outlet port may fluidly connect to other conduits, ductwork, or channels within the rotor 300, stator 302, the first seal 504, the second seal 506, the third seal 508, the fourth seal 510, and so forth for routing the working fluid to and from the chambers 500.

The second seal 506 and the fourth seal 510 are shown being concentric with one another, about the longitudinal axis 108. Additionally, as shown the fourth seal 510 may annularly extend around the second seal 506, so as to encircle or be disposed over the second seal 506.

Figure 12:
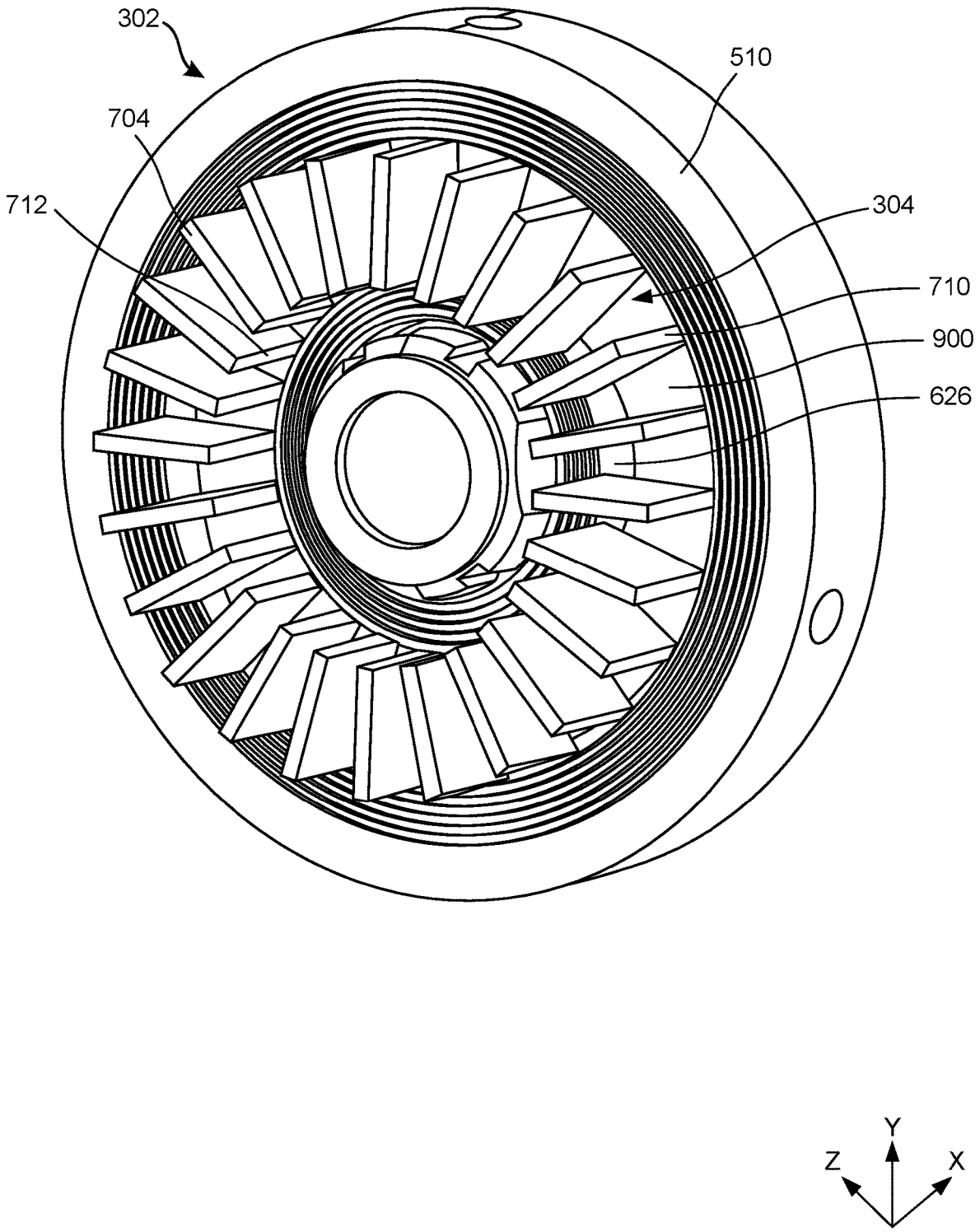
FIG. 12 illustrates the vanes of FIG. 7 engaging with the stator of FIG. 9, according to an example of the present disclosure.

FIG. 12 illustrates the vanes 304 engaged with the stator 302. As illustrated, the vanes 304 engage with the cam surface 900 such that the proximal end 706 of the vanes 304, external to the slots 700 engage with the cam surface 900. That is, the proximal end 706 of the vanes 304 extend external to the slots 700 for engaging with the cam surface 900 and traversing along the cam surface 900 as the rotor 300 rotates. Additionally, the first lateral side 710 of the vanes 304 engage (or traverse along) the third interior surface 620 of the third seal 508 and the fourth interior surface 622 of the fourth seal 510. In some instances, the first lateral side 710 includes a shape or contour that is complimentary with the third interior surface 620 of the third seal 508 and the fourth interior surface 622 of the fourth seal 510. For example, the first lateral side 710 may include a convex curvature for engaging with the concave shape of the third interior surface 620 of the third seal 508 and the fourth interior surface 622 of the fourth seal 510. The second lateral side 712 of the vanes 304 engage (or traverse along) the first outer surface 624 of the first seal 504 and the second outer surface 626 of the second seal 506. In some instances, the second lateral side 712 includes a shape or contour that is complimentary with the first outer surface 624 of the first seal 504 and the second outer surface 626 of the second seal 506. For example, the second lateral side 712 may include a convex curvature for engaging with the concave shape of the first outer surface 624 of the first seal 504 and the second outer surface 626 of the second seal 506.

As will be discussed herein, the biasing members 502 are configured to bias the vanes 304 into contact with the cam surface 900 such that the proximal end 706 of the vanes 304 are sealed against the cam surface 900. Additionally, the vanes 304 may be biased or otherwise forced against the cam surface 900 based on a pressure within the chambers 500 exerting a force against the distal end 704 of the vanes 304. This force serves as a pressure-assist to ensure contact between the proximal end 706 of the vanes 304 and the cam surface 900. Additionally, the pressure-assist maintains contact between the vanes 304 and the slots 700, such as a sidewall of the slots 700, to prevent blowby of the working fluid around the vanes 304 and/or into the environment.

Figure 13:
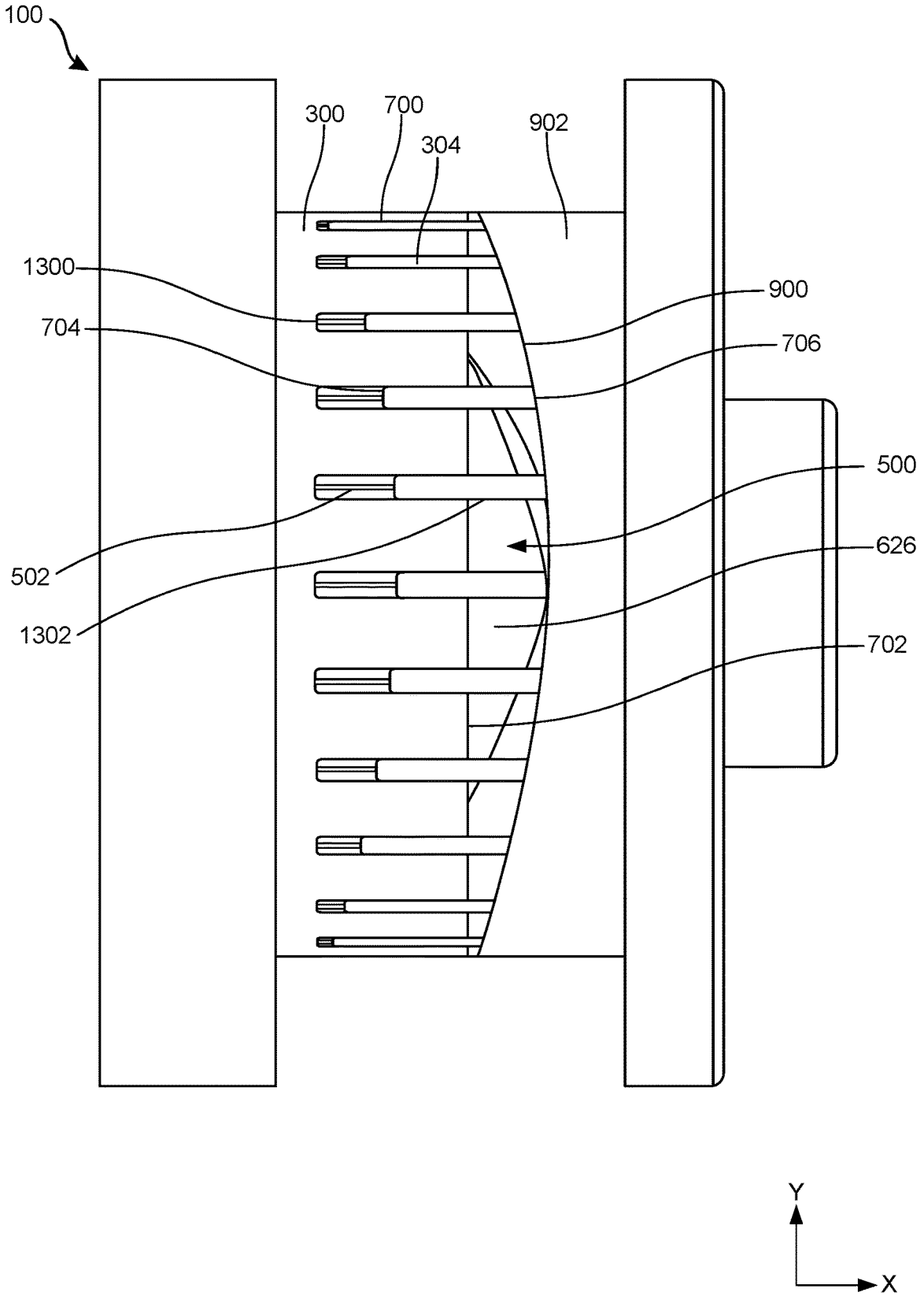
FIG. 13 illustrates the vanes of FIG. 7 being received at least partially within the slots of the rotor of FIG. 7, and the vanes engaging with the stator of FIG. 9, according to an example of the present disclosure.

FIG. 13 illustrates a side view of the rotary device 100, showing the vanes 304 disposed within the rotor 300 and engaging with the stator 302. The rotor 300 defines the slots 700 that at least partially receive the vanes 304. As shown, the slots 700 may extend through less than an entirety of a thickness of the rotor (X-direction). The biasing members 502 extend between an end 1300 of the slots 700 and the vanes 304, so as to engage with the distal end 704 of the vanes 304 to bias the vanes 304 in a direction towards the cam surface 900.

As also shown, given the undulation of the cam surface 900, the vanes 304 extend by respective amounts from the slots 700 to engage with the cam surface 900. For example, during a low point on the cam surface 900, the vanes 304 may extend their greatest length from the slots 700, and during a high point on the cam surface 900, the vanes 304 may extend their least amount from the slots 700. The undulation of the cam surface 900 forces the vanes 304 into the slots 700 as the rotor 300 rotates, which the biasing members 502 and the pressure-assist provided by the pressure within the chambers 500 forces the vanes 304 into contact with the cam surface 900.

The chambers 500 are shown being defined as a volume between adjacent vanes 304. For example, the vanes 304 are shown including faces 1302 that extend between the proximal end 706 and the distal end 704 of the vanes 304. The faces 1302 extend into and out of the slots 700. When the faces 1302 are disposed out of the slots 700, the faces 1302 define lateral sides of the chambers 500. Additionally, the surface 702 of the rotor 300 and the cam surface 900 of the stator 302 define ends of the chambers 500. As also discussed above, the first outer surface 624 of the first seal 504 and the second outer surface 626 of the second seal 506 define additional lateral sides of the chambers 500. Although not shown, the third interior surface 620 of the third seal 508 and the fourth interior surface 622 of the fourth seal 510 define additional lateral sides of the chambers 500. As such, given this combination, the chambers 500 are defined or sealed on six sides to prevent leakage of the working fluid.

Moreover, as the proximal end 706 of the vanes 304 become worn, given the engagement with the cam surface 900, the biasing member 502 and pressure-assist provided by the working fluid within the chambers 500 serves to maintain contact between the vanes 304 and the cam surface 900.

As introduced above, the rotary device 100 facilitates the conversion of energy within the working fluid to mechanical energy in multiple ways, for example combustion, expansion, compression, and so forth. This mechanical energy is used to rotate the rotor 300 and the shaft 106. For example, during compression, the working fluid is supplied into the chambers 500 (e.g., via an intake port) during an intake stroke and is trapped between adjacent vanes 304. As the rotor 300 rotates, the working fluid is compressed during a compression stroke due to a decreasing volume between the adjacent vanes 304, or more generally, the chambers 500. The volume of the chambers 500 is constantly decreasing as the vanes 304 approach a peak of the cam surface 900. In some instances, fuel is supplied into the chambers 500, via a fuel injection port, and ignited to expand during an expansion stroke. During this expansion, the vanes 304 move down the cam surface 900 towards a lowest point on the cam surface 900 and the expansion is converted to rotary motion. Thereafter, exhaust gases are forced out through an exhaust port.

As another example, during expansion, a working high-pressure fluid is received through an intake port and is trapped between adjacent vanes 304, within the chamber 500. The high-pressure working fluid expands during the expansion stroke due to the increasing volume between vanes 304. The working fluid drives the vanes 304 until a leading vane reaches an exhaust port. At this time, the expanded working fluid is exhausted.

Figure 14:
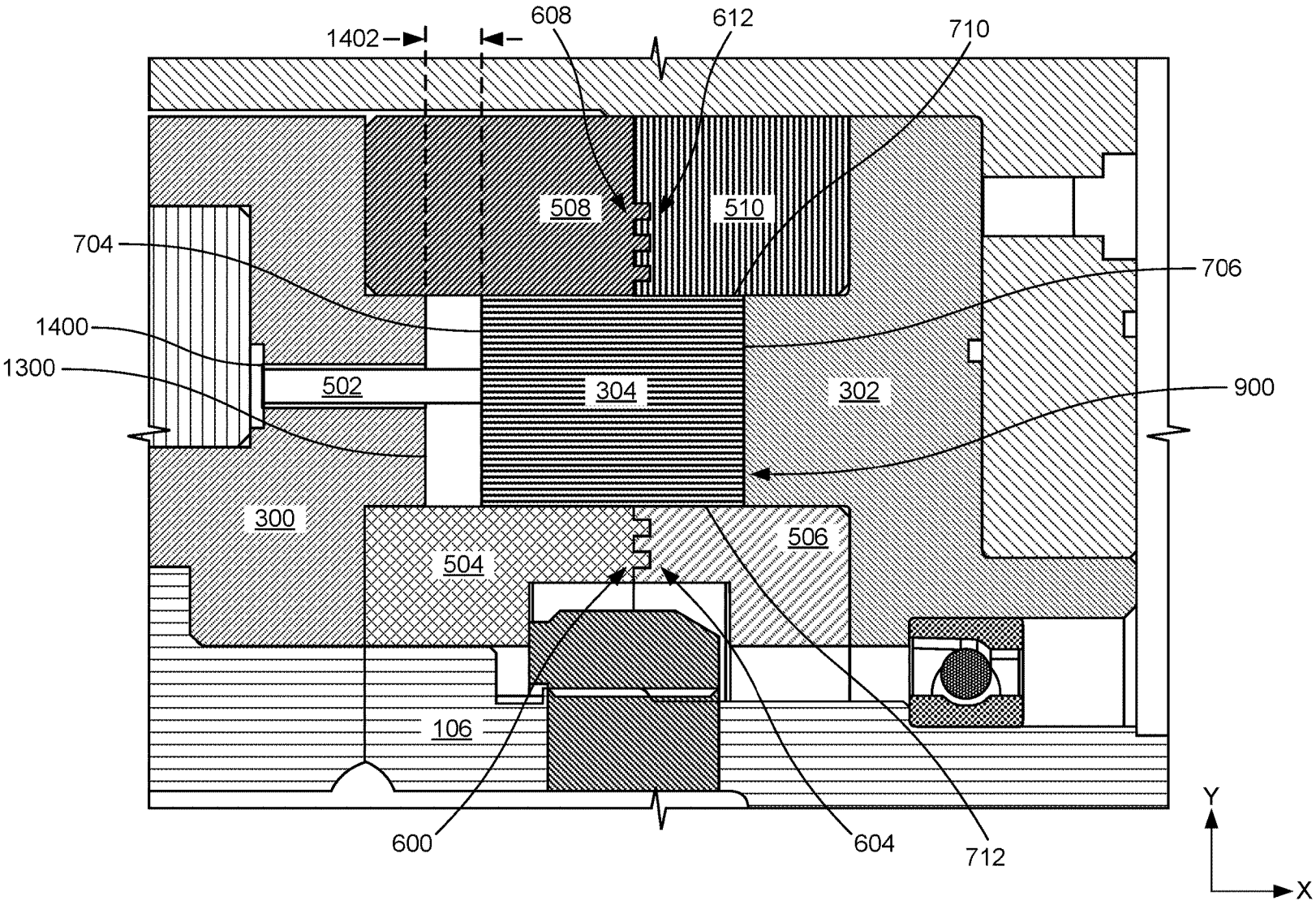
FIG. 14 illustrates a partial cross-sectional view of the rotary device of FIG. 1, taken along line A-A of FIG. 2, showing an example rotor, vanes, and stator, as well as seals that seal chambers of the rotary device, according to an example of the present disclosure.

FIG. 14 illustrates a detailed view showing the vane 304 engaged with components of the rotary device 100. The rotor 300 is shown coupled to the shaft 106, the first seal 504 is shown coupled to the rotor 300 and/or the shaft 106, and the third seal 508 is shown coupled to the rotor 300. The rotor 300 defines a passage 1400 for receiving the biasing member 502. As shown, the biasing member 502 resides within the passage 1400 and extends in a direction for engaging the distal end 704 of the vane 304. In doing so, the vane 304 is advanced in a direction towards the cam surface 900.

The distal end 704 of the vane 304 may be separate from the end 1300 of the slot 700 by a gap distance 1402. The gap distance 1402 variably changes as the rotor 300 rotates and the vanes 304 traverse along the cam surface 900, causing the vanes 304 to retract into and extend from the slots 700. As will be discussed in further detail herein, the gap distance 1402 enables the working fluid to enter the slot 700 and press against the distal end 704 of the vane 304. In doing so, the working fluid provides a pressure-assist to seal the proximal end 706 of the vane 304 against the cam surface 900. Additionally, as will also be discussed herein, the working fluid pushes against the faces 1302 of the vanes 304, laterally forcing the vanes against the slots 700. This lateral force seals the vane 304 against the slot 700 to prevent blowby of the working fluid around the distal end 704 and into adjacent chambers 500.

The first seal 504 and the second seal 506 are shown engaging the second lateral side 712 of the vane 304. Additionally, the first grooves 600 of the first seal 504 and the second grooves 604 of the second seal 506 are complimentary to one another to provide the first labyrinth seal and prevent the working fluid escaping the chamber 500. The third seal 508 and the fourth seal 510 are shown engaging the first lateral side 710 of the vane 304. The third grooves 608 of the third seal 508 and the fourth grooves 612 of the fourth seal 510 are complimentary to one another to provide the second labyrinth seal and prevent the working fluid escaping the chamber 500. That is, the first labyrinth seal and the second labyrinth seal may prevent the working fluid leaking between chambers 500, as well as the working fluid leaking to an environment. More generally, the first labyrinth seal and the second labyrinth seal may seal an interface between the rotor 300 and the stator 302.

Although FIG. 14 illustrates a particular placement of the first labyrinth seal and the second labyrinth seal, the first labyrinth seal and/or the second labyrinth seal may be located elsewhere. For example, in some instances, the first labyrinth seal and the second labyrinth seal may be centered between the cam surface 900 and the surface 702 of the rotor 300 (X-direction). In such instances, the first labyrinth seal and the second labyrinth seal may be located closer to the rotor 300 or closer to the stator 302 than illustrated. That is to say, the first seal 504, the second seal 506, the third seal 508, and/or the fourth seal 510 may include longer or shorter lengths than shown (X-direction) to as to adjust a position of the first labyrinth seal and the second labyrinth seal. In such instances, the locations of the first grooves 600, the second grooves 604, the third grooves 608, and/or the fourth grooves 612 may vary than as shown. As an example, the first seal 504 may be shorter than shown (X-direction) and the second seal 506 may be longer than shown (X-direction), and in such instances, the second grooves 604 may be located closer to the rotor 300 than shown.

Additionally, in some instances, the rotary device 100 may only include one of the first labyrinth seal and the second labyrinth seal. For example, the second labyrinth seal may be replaced with other types of seals or differently shaped seals than shown. Additionally, the first grooves 600, the second grooves 604, the third grooves 608, and/or the fourth grooves 612 may be oriented different than shown. For example, the first grooves 600 and the second grooves 604 may be oriented in a direction parallel to the longitudinal axis 108, while the third grooves 608 and the fourth grooves 612 may be located in a direction orthogonal to the longitudinal axis 108.

The first labyrinth seal and the second labyrinth seal may also form an air bearing or buffer. Such bearing or buffer, for example, may provide "lift" and assist in reducing friction or resistance that prevents rotation of the rotor 300. However, in some instances, the rotary device 100 may include one of the first labyrinth seal or the second labyrinth seal, or may include a greater number of labyrinth seals than illustrated.

Figure 15B:
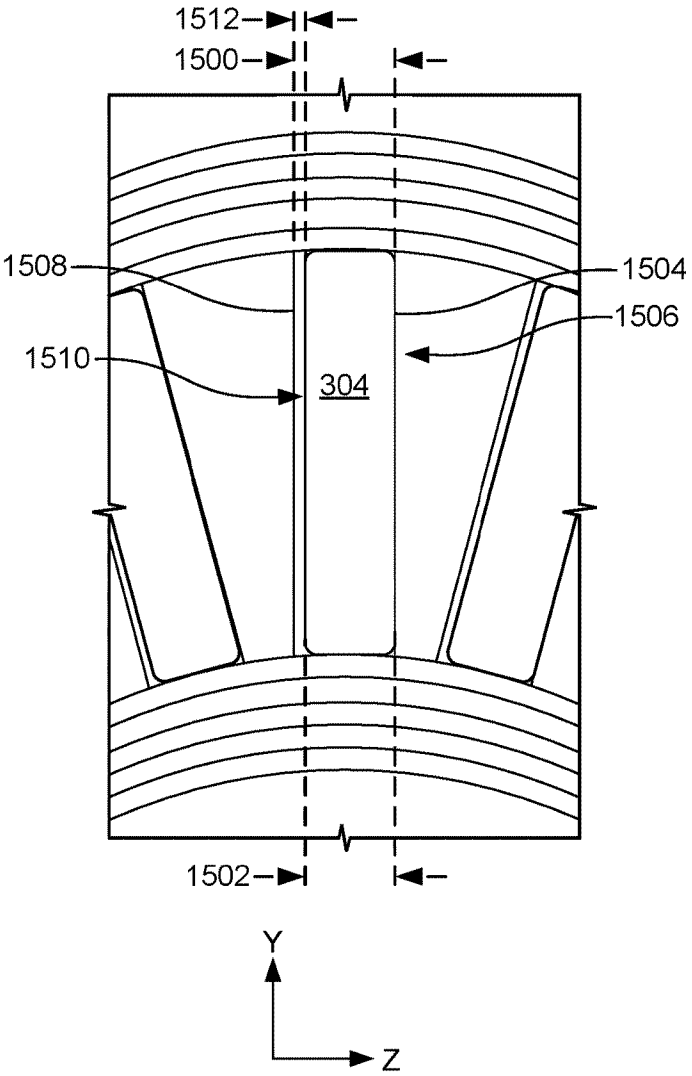
FIG. 15B illustrates an example rotor and vanes of the rotary device of FIG. 1, as well as seals that seal chambers of the rotary device, according to an example of the present disclosure.
Figure 15A:
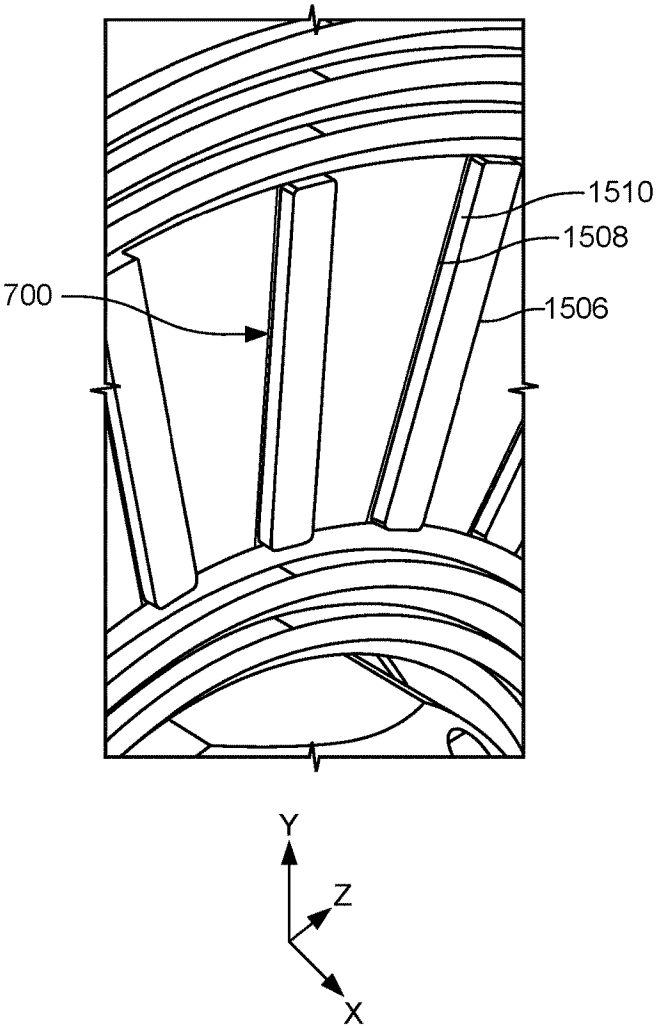
FIG. 15A illustrates an example rotor and vanes of the rotary device of FIG. 1, as well as seals that seal chambers of the rotary device, according to an example of the present disclosure.

FIGS. 15A and 15B illustrate a positioning of the vanes 304 within the slots 700. The slots 700 are shown including a first width 1500 (Z-direction) for receiving a second width 1502 of the vanes 304. The first width 1500 is greater than the second width 1502 to provide a pressure-assist and seal the vanes 304 to and within the slots 700. For example, during rotation of the rotor 300, such as in a clockwise direction about the longitudinal axis 108 (about the X-axis), the vanes 304 are shown contacting a first sidewall 1504 of the slots 700. More particularly, a first face 1506 of the vanes 304 may contact the first sidewall 1504 and seal the vane 304 against the slot 700. The working fluid enters a gap distance 1512 between a second sidewall 1508 of the slot 700 (opposite the first sidewall 1504) and a second face 1510 of the vane 304 (opposite the first face 1506). The working fluid applies pressure against the second face 1510, forcing the first face 1506 against the first sidewall 1504. This, in effect, prevents the working fluid routing around the distal end 704 of the vane 304 and between the first sidewall 1504 and the first face 1506.

Moreover, as discussed above in FIG. 14, the gap distance 1512 permits the working fluid to apply a pressure against the distal end 704 of the vane 304 and force the proximal end 706 of the vane 304 against the cam surface 900. As such, given that the first width 1500 of the slot 700 is greater than the second width 1502 of the slot 700, the working fluid may apply a pressure-assist to seal the chambers 500 and prevent escape of the working fluid.

Rotation in an opposite direction, such as in the counter-clockwise direction about the longitudinal axis 108, causes the vane 304 to contact the second sidewall 1508 of the slot 700. For example, during an expanding operation in which the working fluid is expanded within the chambers 500, the second face 1510 of the vane 304 may contact the second sidewall 1508 of the slot 700. Similar to the discussion above, the working fluid may enter a gap distance between the first sidewall 1504 and the first face 1506 to apply pressure against the first face 1506 and force the second face 1510 against the second sidewall 1508. As such, the vanes 304 may laterally translate within the slots 700 to provide a pressure-assist and seal the chambers 500.

Figure 16:
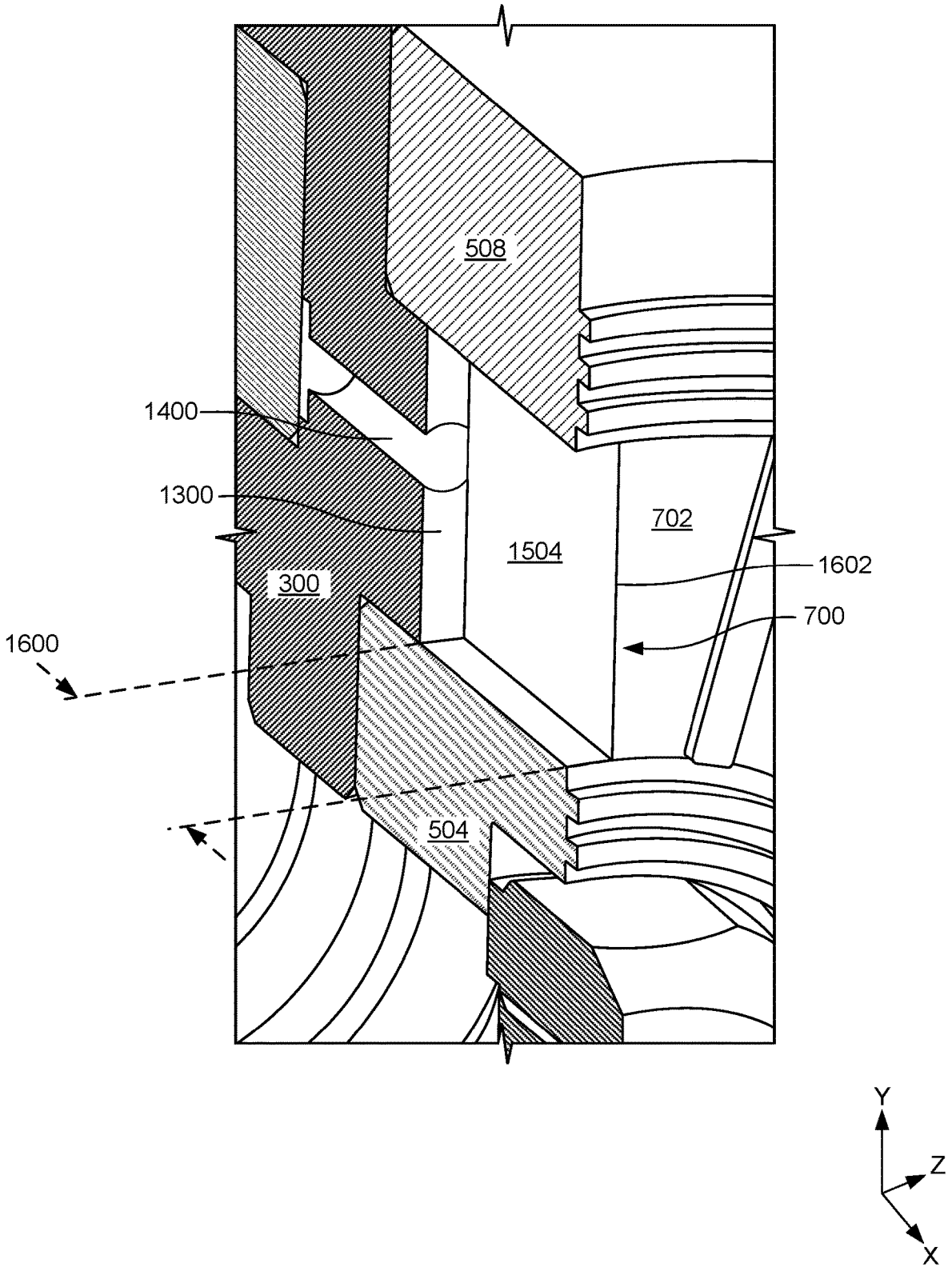
FIG. 16 illustrates an example cross-sectional view of the rotary device of FIG. 1, taken along line A-A of FIG. 2, showing an example rotor having a slot within which a vane is received, according to an example of the present disclosure.

FIG. 16 illustrates a cross-sectional view of the rotary device 100, taken along line A-A of FIG. 2. In FIG. 16, the vane 304 is shown removed from the slot 700, and the biasing member 502 is shown removed from the passage 1400.

As introduced above, the rotor 300 forms the slot 700, which may extend through less than an entirety of a thickness of the rotor 300 (X-direction). The slot 700 includes the end 1300 and the passage 1400 extends from within the rotor 300 to the end 1300. The passage 1400 is sized to receive the biasing member 502 to engage with the distal end 704 of the vane 304. The proximal end 706, meanwhile, extends out an opening 1602 of the slot 700 to engage the cam surface 900. The slot 700 is further shown being defined by the first sidewall 1504, which is formed within the rotor 300. The slot 700 also includes a depth 1600 for accommodating a depth of the vane 304.

Figure 17:
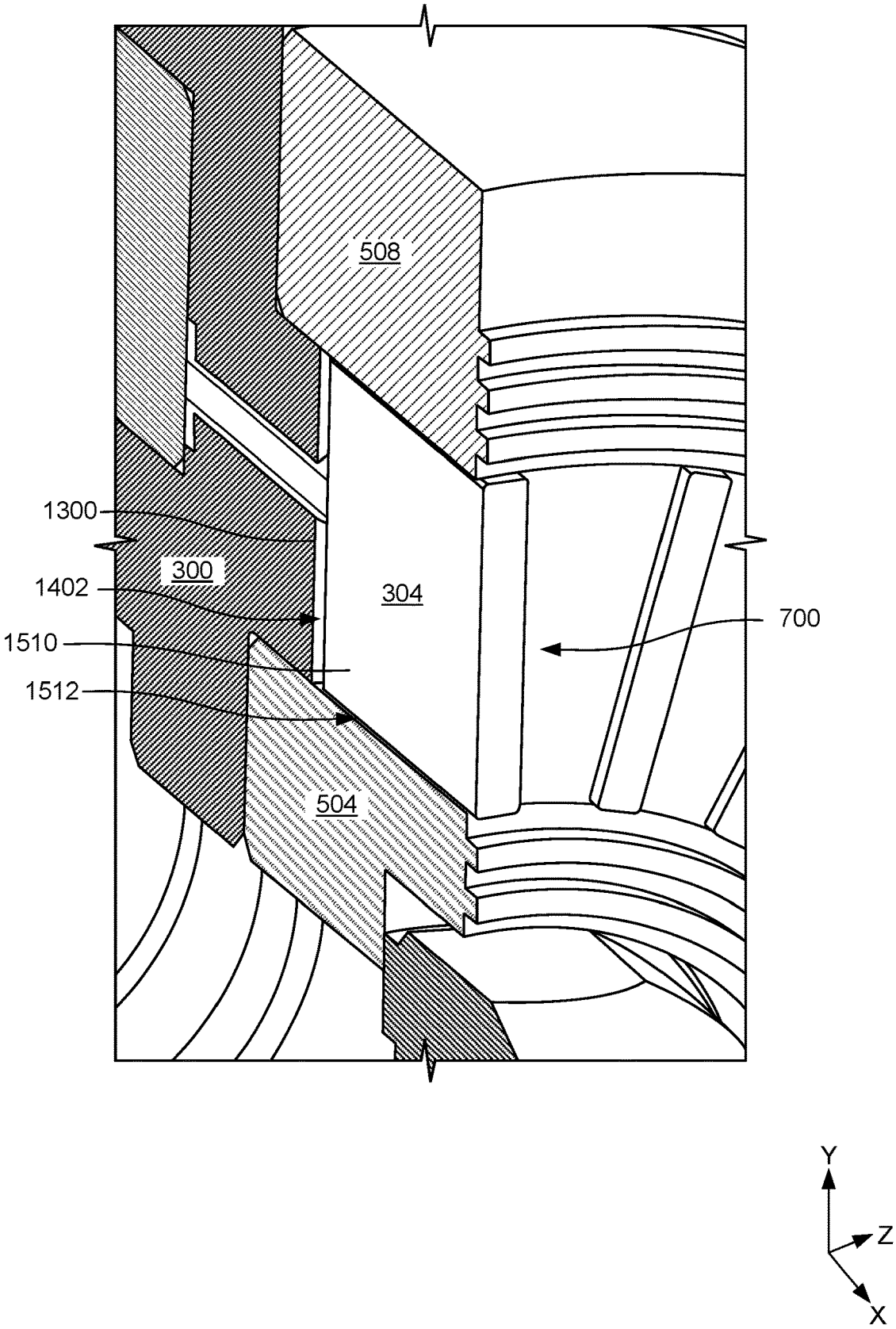
FIG. 17 illustrates an example cross-sectional view of the rotary device of FIG. 1, taken along line A-A of FIG. 2, showing an example rotor as well as an example vane received at least partially within the slot of FIG. 7, according to an example of the present disclosure.

FIG. 17 illustrates a cross-sectional view of the rotary device 100, taken along line A-A of FIG. 2. In FIG. 17, the vane 304 is shown disposed within the slot 700. The gap distance 1512 between the vane 304 and the sidewalls of the slot 700, whether between the first face 1506 and the first sidewall 1504 or the second face 1510 and the second sidewall 1508, allows the working fluid to provide the pressure-assist. For example, the working fluid may enter a volume defined by the gap distance 1512 and press against the second face 1510 of the vane 304 (as shown in FIG. 17). Additionally, the gap distance 1512 allows the working fluid to enter a volume defined by the gap distance 1402 and press against the distal end 704 of the vane 304.

Figure 18:
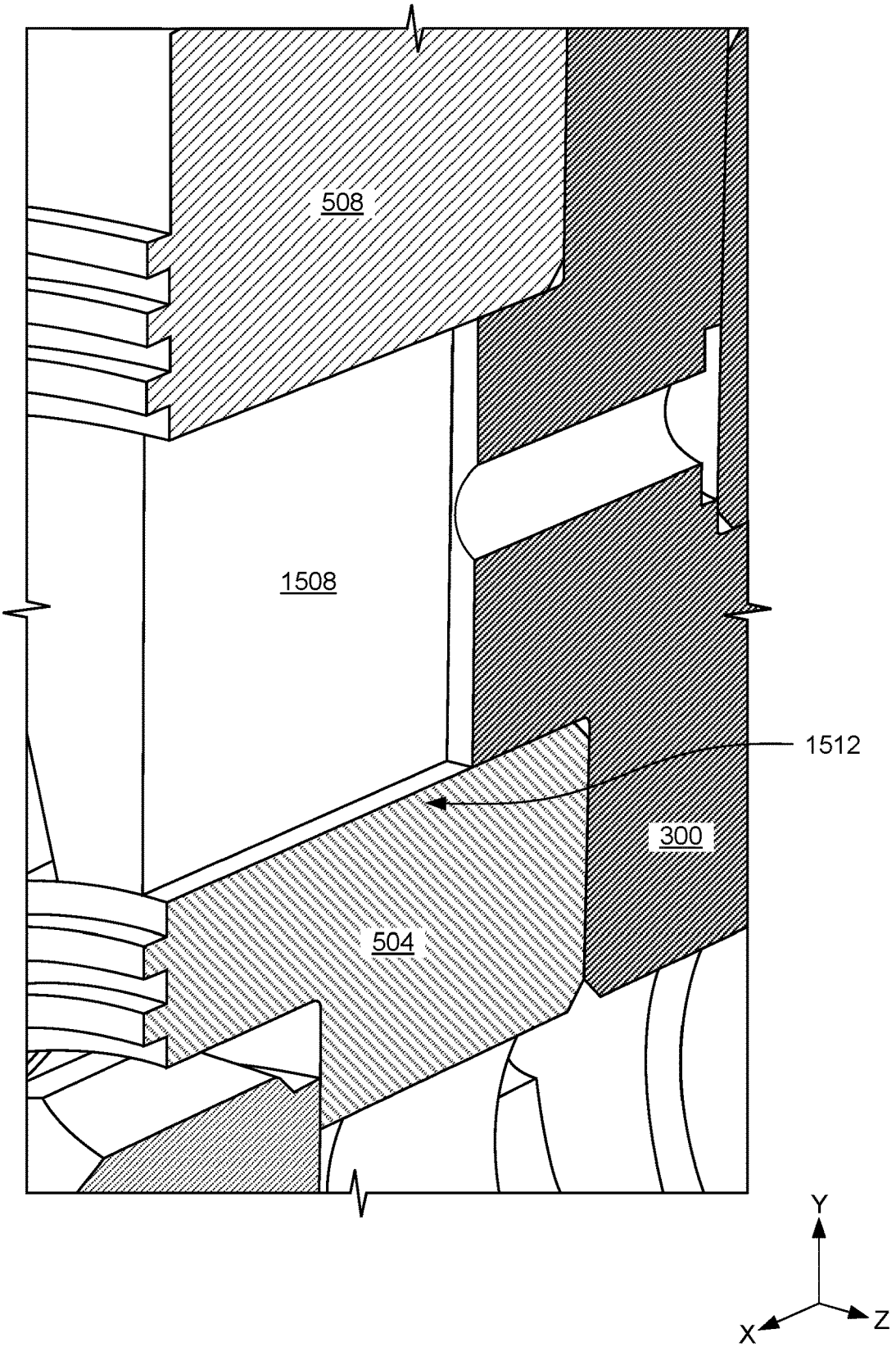
FIG. 18 illustrates an example cross-sectional view of the rotary device of FIG. 1, taken along line B-B of FIG. 2, showing an example rotor having a slot within which a vane is received, according to an example of the present disclosure.

FIG. 18 illustrates a cross-sectional view of the rotary device 100, taken along line B-B of FIG. 2. FIG. 18 illustrates the gap distance 1512 interposed between the second sidewall 1508 of the slot 700 and the second face 1510 of the vane 304. As discussed in detail above, the gap distance 1512 permits the working fluid to press against the vane 304, such as the second face 1510 of the vane 304. Additionally, the gap distance 1512 permits the working fluid to advance to the end 1300 of the slot 700, within the gap distance 1402, and press against the distal end 704 of vane 304.

Figure 19:
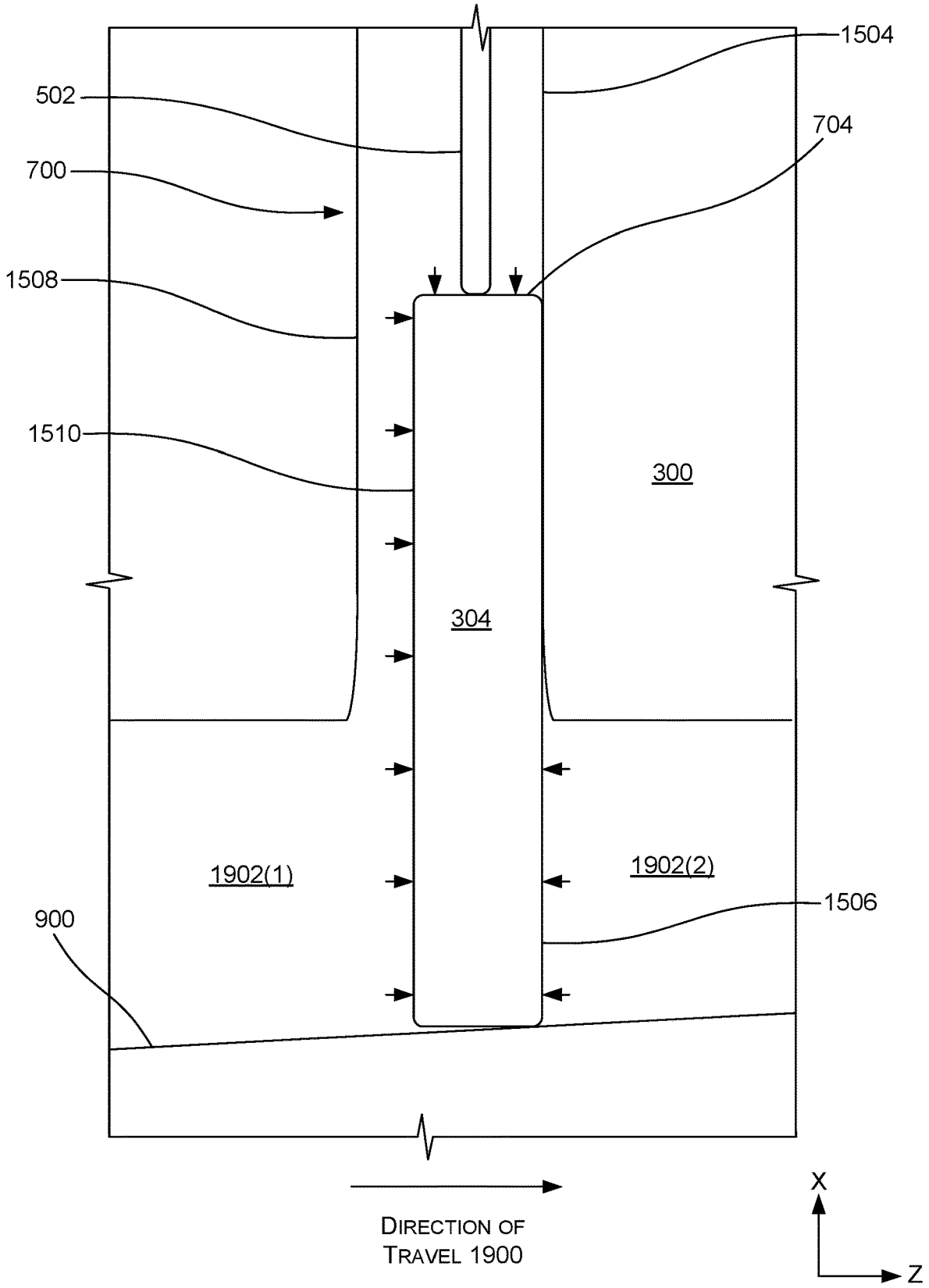
FIG. 19 illustrates an example vane of the rotary device of FIG. 1, showing forces acting on the vane, according to an example of the present disclosure.

FIG. 19 illustrates a simplified view of the rotary device 100, showing the vane 304 engaged with the cam surface 900. As discussed above, the vane 304 traverses along the cam surface 900 in a direction of travel 1900. The biasing member 502 applies a force to the distal end 704 of the vane 304 to urge the vane 304 into contact with the cam surface 900. In some instances, the distal end 704 of the vane 304 is complimentary with the cam surface 900 (e.g., curved).

In addition, pressure of the working fluid within the chambers 500 provides a pressure-assist to seal the vanes 304 against the sidewalls of the slot 700 as well as the cam surface 900. In FIG. 19, a first chamber 1902(1) and a second chamber 1902(2) are shown as being adjacent chambers. The first chamber 1902(1) and the second chamber 1902(2) may be presentative of the chambers 500. Working fluid within the first chamber 1902(1) applies a force against the second face 1510 of the vane 304. This force urges the first face 1506 of the vane 304 against the first sidewall 1504 of the slot 700. In doing so, the working fluid is prevented from leaking into the second chamber 1902(2) (e.g., around and over the distal end 704 of the vane 304). Working fluid within the second chamber 1902(2), however, applies a force against the first face 1506 of the vane 304. This force is opposite to the force applied by the working fluid within the first chamber 1902(1) against the second face 1510. However, being as a greater amount of surface area is exposed to working fluid within the first chamber 1902(1), the force exerted on the second face 1510 to urge the vane 304 into contact with the first sidewall 1504 is greater than the force exerted on the first face 1506 (via the working fluid within the second chamber 1902(2)) to urge the vane 304 into contact with the second sidewall 1508. As such, the vane 304 contacts the first sidewall 1504 to seal the first chamber 1902(1) from the second chamber 1902(2), vice versa. Additionally, the working fluid within the first chamber 1902(1) applies an additional force against the distal end 704 of the vane 304 to urge the vane 304 into contact with the cam surface 900. In doing so, the pressure of the working fluid is able to seal the vane 304 against the sidewall(s) of the slot 700. In some instances, the force applied to the second face 1510 resists pivotable movement of the vane (e.g., about the X-axis) caused by friction between the vane 304 and the cam surface 900 and/or the force exerted on the first face 1506.

As such, the slot 700 in which the vane 304 resides in the rotor 300 is designed with clearances such that the pressure of the working fluid is able get behind the vane 304 and increase the sealing force against the cam surface 900 and the slot 700. This pressure-assist has several advantages. For example, the sealing force varies based on the pressure within the chambers 500. In other words, the higher the pressure that is needed to seal the vane 304, the greater the sealing force is generated from the working fluid. When the pressure is lower, less sealing force is needed and the sealing force is automatically adjusted. In such instances, the friction against the vane 304 and the cam surface 900 is lessened, which reduces the friction and wear of the vane 304 and the cam surface 900. Additionally, the vane 304 automatically adjusts as wear starts occurring. For example, the force on the distal end 704 of the vane 304 will force the proximal end 706 of the vane 304 to stay in contact with the cam surface 900.

While one or more examples of the techniques described herein have been described, various alterations, additions, permutations and equivalents thereof are included within the scope of the techniques described herein.

In the description of examples, reference is made to the accompanying drawings that form a part hereof, which show by way of illustration specific examples of the claimed subject matter. It is to be understood that other examples may be used and that changes or alterations, such as structural changes, may be made. Such examples, changes or alterations are not necessarily departures from the scope with respect to the intended claimed subject matter. While the steps herein may be presented in a certain order, in some cases the ordering may be changed so that certain inputs are provided at different times or in a different order without changing the function of the systems and methods described. The disclosed procedures could also be executed in different orders. Additionally, various computations that are herein need not be performed in the order disclosed, and other examples using alternative orderings of the computations could be readily implemented. In addition to being reordered, the computations could also be decomposed into sub-computations with the same results.

What is claimed is:

1. A rotary device, comprising:

a shaft;

a rotor coupled to the shaft and configured to rotate with the shaft, the rotor defining a plurality of slots;

a plurality of vanes, individual vanes of the plurality of vanes residing at least partially within individual slots of the plurality of slots;

a stator including a cam surface, the individual vanes of the plurality of vanes engaging with the cam surface;

a first seal coupled to the rotor, the first seal including first grooves extending in a direction substantially parallel to a rotational axis of the shaft;

a second seal coupled to the stator, the second seal including second grooves extending in the direction substantially parallel to the rotational axis, the first grooves and the second grooves forming a first labyrinth seal for chambers of the rotary device;

a third seal coupled to the rotor, the third seal including third grooves extending in the direction substantially parallel to the rotational axis; and a fourth seal coupled to the stator, the fourth seal including fourth grooves extending in the direction substantially parallel to the rotational axis, the third grooves and the fourth grooves forming a second labyrinth seal for the chambers of the rotary device.

2. The rotary device of claim 1, wherein individual chambers of the chambers are defined at least in part by:

the cam surface;

the rotor;

two adjacent vanes of the plurality of vanes;

the first seal;

the second seal;

the third seal; and the fourth seal.

3. The rotary device of claim 1, wherein the vanes are configured to axially translate within the slots in the direction substantially parallel to the rotational axis.

4. The rotary device of claim 1, wherein:

the individual slots include:

an end, a first sidewall, and a second sidewall opposite the first sidewall;

the individual vanes include:

a distal end configured to reside within the individual slots and a proximal end configured to engage the cam surface, a first face configured to contact the first sidewall during rotation of the rotor and based at least in part on pressure within individual chambers of the chambers, and a second face configured to be spaced apart from the second sidewall during rotation of the rotor; and a plurality of springs, wherein individual springs are disengaged within the individual slots, between the end of the individual slots and the distal end of the individual vanes.

5. The rotary device of claim 1, wherein:

the first grooves extend annularly around the first seal;

the second grooves extend annularly around the second seal;

the third grooves extend annularly around the third seal; and the fourth grooves extend annularly around the fourth seal.

6. The rotary device of claim 1, wherein:

the rotor includes a first inside surface and a first outside surface;

the stator includes a second inside surface and a second outside surface;

the first seal at least partially contacts the first inside surface;

the second seal at least partially contacts the second inside surface;

the third seal at least partially contacts the first outside surface; and the fourth seal at least partially contacts the second outside surface.

7. A device, comprising:

a shaft having a rotational axis;

a rotor coupled to the shaft, the rotor being configured to receive vanes;

a stator;

a first seal coupled to a first side of the rotor, the first seal including one or more first grooves that extend in a direction substantially parallel to the rotational axis;

a second seal coupled to a first side of the stator, the second seal including one or more second grooves that extend in the direction substantially parallel to the rotational axis, the one or more second grooves being complimentary with the one or more first grooves;

a third seal coupled to a second side of the rotor;

a fourth seal coupled to a second side of the stator; and chambers sealed at least in part by the first seal, the second seal, the third seal, and the fourth seal.

8. The device of claim 7, wherein the chambers are formed between the rotor, the stator, the first seal, the second seal, the third seal, the fourth seal, and adjacent vanes of the vanes.

9. The device of claim 7, wherein:

the rotor includes slots, individual slots of the slots receive individual vanes of the vanes; and the individual vanes include a distal end and a proximal end, the distal end being engaged with a biasing member extending from an end of the slot, the proximal end engaging with a cam surface of the stator.

10. The device of claim 9, wherein:

the individual slots are defined at least in part by the end, a first sidewall, and a second sidewall;

the individual vanes are defined at least in part by the distal end, the proximal end, a first face, and a second face opposite the first face; and during rotation of the rotor:

the first face is urged against the first sidewall to form a seal between adj acent vanes of the vanes, the second face is spaced apart from the second sidewall, and the distal end is spaced apart from the end of the individual slots to seal the proximal end of the individual vanes against the cam surface.

11. The device of claim 7, wherein:

the third seal includes one or more third grooves that extend in the direction substantially parallel to the rotational axis; and the fourth seal includes one or more fourth grooves that extend in the direction substantially parallel to the rotational axis, the one or more fourth grooves being complimentary with the one or more third grooves.

12. The device of claim 7, wherein:

the rotor includes a first surface;

the stator includes a cam surface along which the vanes engage;

the first seal includes a second surface;

the second seal includes a third surface;

the third seal includes a fourth surface;

the fourth seal includes a fifth surface; and the first surface, the cam surface, the second surface, the third surface, the fourth surface, and the fifth surface define the chambers of the device.

13. The device of claim 7, wherein the one or more first grooves and the one or more second grooves are complimentary to form a labyrinth seal of the device.

14. The device of claim 7, wherein:

the first seal represents a ring structure coupled to the rotor;

the second seal represents a structure coupled to the stator;

the third seal represents a structure coupled to the rotor; or the fourth seal represents a ring structure coupled to the stator.

15. The device of claim 7, further comprising:

one or more inlet ports fluidly connected to the chambers, the one or more inlet ports defined by at least one of the stator, the second seal, or the fourth seal; and one or more outlet ports fluidly connected to the chambers, the one or more outlet ports defined by the at least one of the stator, the second seal, or the fourth seal.

16. A device, comprising:

a shaft configured to rotate about a rotational axis;

a rotor coupled to the shaft, the rotor defining a plurality of slots;

a plurality of vanes, individual vanes of the plurality of vanes residing within individual slots of the plurality of slots, the plurality of vanes being configured to translate in a direction substantially parallel to the rotational axis;

a stator;

a first seal coupled to the rotor;

a second seal coupled to the stator;

a third seal coupled to the rotor and disposed at least partially around the first seal, the third seal including one or more first grooves that extend in the direction substantially parallel to the rotational axis; and a fourth seal coupled to the stator and disposed at least partially around the second seal, the fourth seal including one or more second grooves that extend in the direction substantially parallel to the rotational axis, the one or more second grooves being complimentary with the one or more first grooves to form a labyrinth seal for chambers of the device.

17. The device of claim 16, wherein:

the first seal includes one or more third grooves that extend in the direction substantially parallel to the rotational axis; and the second seal includes one or more fourth grooves that extend in the direction substantially parallel to the rotational axis, the one or more fourth grooves being complimentary with the one or more third grooves to form a second labyrinth seal for the chambers of the device.

18. The device of claim 16, wherein:

the individual slots are defined at least in part by an end, a first sidewall, and a second sidewall;

the individual vanes are defined at least in part by a distal end, a proximal end, a first face, and a second face opposite the first face; and during rotation of the rotor:

the first face is urged against the first sidewall to form a seal between adj acent vanes of the vanes, the second face is spaced apart from the second sidewall, and the distal end is spaced apart from the end of the individual slots to seal the proximal end of the individual vanes against a cam surface of the stator.

19. The device of claim 16, wherein the chambers are formed between the rotor, the stator, the first seal, the second seal, the third seal, the fourth seal, and adjacent vanes of the plurality of vanes.

20. The device of claim 16, wherein the individual vanes include a distal end and a proximal end, the distal end being engaged with a biasing member extending from an end of the slot, the proximal end engaging with a cam surface of the stator.

* * * * *